US009284806B2

(12) United States Patent
Gutierrez et al.

(10) Patent No.: US 9,284,806 B2
(45) Date of Patent: Mar. 15, 2016

(54) SYSTEMS AND METHODS FOR PULLING SUBSEA STRUCTURES

(71) Applicant: BP Corporation North America Inc., Naperville, IL (US)

(72) Inventors: Daniel Gutierrez, Houston, TX (US); Luis J. Gutierrez, Houston, TX (US); Parker Berry, Katy, TX (US)

(73) Assignee: BP Corporation North America Inc., Houston, TX (US)

( * ) Notice: Subject to any disclaimer, the term of this patent is extended or adjusted under 35 U.S.C. 154(b) by 0 days.

(21) Appl. No.: 14/293,264

(22) Filed: Jun. 2, 2014

(65) Prior Publication Data

US 2014/0352972 A1 Dec. 4, 2014

Related U.S. Application Data

(60) Provisional application No. 61/829,706, filed on May 31, 2013.

(51) Int. Cl.

| | |
|---|---|
| ***E21B 7/12*** | (2006.01) |
| ***E21B 29/10*** | (2006.01) |
| ***E21B 29/12*** | (2006.01) |
| ***E21B 41/04*** | (2006.01) |
| ***E21B 43/013*** | (2006.01) |

(52) U.S. Cl.

CPC ..... *E21B 29/10* (2013.01); *E21B 29/12* (2013.01); *E21B 41/04* (2013.01); *E21B 43/013* (2013.01)

(58) Field of Classification Search

CPC ..... E21B 29/10; E21B 29/12; E21B 41/0007; E21B 41/04

USPC ..... 166/335, 343

See application file for complete search history.

(56) References Cited

U.S. PATENT DOCUMENTS

| | | | | |
|---|---|---|---|---|
| 4,529,334 | A | 7/1985 | Ortloff | |
| 4,597,350 | A * | 7/1986 | Mott | 114/230.13 |
| 4,640,647 | A * | 2/1987 | Blair et al. | 405/224.2 |
| 4,710,061 | A * | 12/1987 | Blair et al. | 405/195.1 |
| 4,818,146 | A * | 4/1989 | Fontenot | 405/212 |
| 5,788,417 | A * | 8/1998 | Fontenot et al. | 405/224 |
| 5,885,028 | A * | 3/1999 | Blanchard et al. | 405/210 |
| 7,140,319 | B2 * | 11/2006 | Raines | 114/296 |
| 7,287,935 | B1 * | 10/2007 | Gehring | 405/223.1 |
| 8,882,392 | B1 * | 11/2014 | Cruz et al. | 405/172 |

(Continued)

FOREIGN PATENT DOCUMENTS

| | | |
|---|---|---|
| EP | 0296056 | 12/1988 |
| WO | WO-2012/151060 | 11/2012 |

*Primary Examiner* — Matthew R Buck
*Assistant Examiner* — Aaron Lembo
(74) *Attorney, Agent, or Firm* — Jayne C. Piana

(57) ABSTRACT

A system for pulling a subsea structure includes an adapter configured to be mounted to an upper end of a subsea pile. In addition, the system includes an interface assembly fixably coupled to the adapter. The interface assembly includes a first channel configured to receive a flexible tension member and a first chuck disposed in the first channel. The tension assembly includes a second channel configured to receive the flexible tension member and a second chuck disposed in the second channel. Each chuck is configured to pivot about a horizontal axis between an unlocked position allowing the flexible tension member to move in a first axial direction and a locked position preventing the tension member from moving in a second axial direction that is opposite the first axial direction.

29 Claims, 30 Drawing Sheets

(56) References Cited

U.S. PATENT DOCUMENTS

2012/0292037 A1* 11/2012 Gutierrez et al. ..... 166/341
2014/0339485 A1* 11/2014 Busson ..... 254/389
2014/0374115 A1* 12/2014 Kebadze et al. ..... 166/345
2014/0374116 A1* 12/2014 Kelso et al. ..... 166/345

* cited by examiner

SYSTEMS AND METHODS FOR PULLING SUBSEA STRUCTURES

CROSS-REFERENCE TO RELATED APPLICATIONS

This application claims the benefit of priority from U.S. Provisional Application No. 61/829,706, filed May 31, 2013, which is expressly incorporated herein in its entirety.

STATEMENT REGARDING FEDERALLY SPONSORED RESEARCH OR DEVELOPMENT

Not applicable.

BACKGROUND

The invention relates generally to remedial systems and methods for subsea structures. More particularly, the invention relates to systems and methods for pulling subsea structures such as primary conductors that have been bent from vertical.

In offshore drilling operations, subsea wells are built up by installing a primary conductor in the seabed and then securing a wellhead to the upper end of the primary conductor at the sea floor. A blowout preventer (BOP) is then installed on the wellhead, and a lower marine riser package (LMRP) mounted to the BOP. The primary conductor is typically installed in a vertical orientation to facilitate and simplify the installation of the BOP and LMRP onto the wellhead, which is coaxially aligned with the primary conductor. A lower end of a drilling riser is coupled to a flex joint on the top of the LMRP and extends to a drilling vessel or rig at the sea surface. A drill string is then suspended from the rig through the drilling riser, LMRP, BOP, wellhead, and primary conductor to drill a borehole while successively installing concentric casing strings that line the borehole. The casing strings are typically cemented at their lower ends and sealed with mechanical seals at their upper ends.

During drilling operations, drilling fluid, or mud, is delivered through the drill string, and returned up an annulus between the drill string and casing that lines the borehole. In the event of a rapid influx of formation fluid into the annulus, commonly known as a "kick," the BOP and/or LMRP may actuate to seal the annulus and control the well. In particular, BOPs and LMRPs comprise closure members capable of sealing and closing the well in order to prevent the release of high-pressure gas or liquids from the well. Thus, the BOP and LMRP are used as safety devices that close, isolate, and seal the wellbore. Heavier drilling mud may be delivered through the drill string, forcing fluid from the annulus through the choke line or kill line to protect the well equipment disposed above the BOP and LMRP from the high pressures associated with the formation fluid. Assuming the structural integrity of the well has not been compromised, drilling operations may resume. However, if drilling operations cannot be resumed, cement or heavier drilling mud is delivered into the well bore to kill the well.

In the event that the BOP and LMRP fail to actuate or insufficiently actuate in response to a surge of formation fluid pressure in the annulus, a blowout may occur. The blowout may damage subsea well equipment and hardware such as the BOP, LMRP, or drilling riser. For example, falling debris (e.g., a severed riser) resulting from a blowout may bend the primary conductor from the "as installed" vertical orientation. Bending of the primary conductor can also arise if the surface vessel drifts too far and exerts sufficiently large lateral loads on the LMRP and BOP via excessive tension applied to the riser extending from the surface vessel to the LMRP. In general, if the bending loads and associated stresses do not exceed the yield strength of the material forming the primary conductor, the primary conductor will not plastically deform and should rebound to its vertical orientation when the bending loads decrease sufficiently. However, if the bending loads and associated stresses exceed the yield strength of the material forming the primary conductor, the primary conductor will plastically deform and become permanently bent (i.e., the primary conductor will not rebound to its vertical orientation when the bending loads decrease).

BRIEF SUMMARY OF THE DISCLOSURE

An embodiment disclosed herein is directed to a system for pulling a subsea structure. The system comprises an adapter configured to be mounted to an upper end of a subsea pile. In addition, the system comprises an interface assembly fixably coupled to the adapter. The interface assembly has a longitudinal axis and includes a first channel configured to receive a flexible tension member and a first chuck disposed in the first channel. The first chuck is configured to pivot about a horizontal axis between an unlocked position allowing the flexible tension member to move through the first channel in a first axial direction and a locked position preventing the tension member from moving through the first channel in a second axial direction that is opposite the first axial direction. Further, the system comprises a tension assembly moveably coupled to the interface assembly. The tension assembly includes a second channel configured to receive the flexible tension member and a second chuck disposed in the second channel. The second chuck is configured to pivot about a horizontal axis between an unlocked position allowing the flexible tension member to move through the second channel in the first axial direction and a locked position preventing the tension member from moving through the second channel in the second axial direction.

Another embodiment disclosed herein is directed to a method for straightening a bent subsea well. The method comprises (a) securing an anchor to the sea floor. In addition, the method comprises (b) lowing an adapter subsea and mounting the adapter to an upper end of the anchor. An interface assembly is fixably coupled to the adapter and a tension assembly is moveably coupled to the adapter. Further, the method comprises (c) coupling a flexible tension member to a primary conductor of the bent well. Still further, the method comprises (d) positioning the tension member in a first channel of the interface assembly and a second channel of the tension assembly. The first channel and the second channel extend linearly along a longitudinal axis. Moreover, the method comprises (e) preventing the tension member from moving in a first axial direction relative to the tension assembly after (d). The method also comprises (f) moving the tension assembly axially relative to the interface assembly in a second axial direction that is opposite the first axial direction and pulling the tension member through the first channel in a second axial direction after (e). In addition, the method comprises (g) applying a tensile load to the tension member during (f).

Another embodiment disclosed herein is directed to a system for pulling a subsea structure. The system comprises a pile secured to the sea floor. In addition, the system comprises an adapter mounted to an upper end of the pile. Further, the system comprises an interface assembly coupled to the adapter. The interface assembly includes a pair of laterally spaced guide members, a recess disposed between the guide members, a retainer disposed in the recess, and a tension member disposed in the recess and positively engaged by the retainer. Still further, the system comprises a tension assembly coupled to the interface assembly and configured to apply a tensile load to the tension member.

Another embodiment disclosed herein is directed to a system for pulling a subsea structure. The system comprises an anchor configured to be secured to the sea floor. In addition, the system comprises a linear actuator having a central axis, a first end coupled to the anchor, and a second end opposite the first end. The linear actuator is configured to move the first end axially relative to the second end. Further, the system comprises a flexible tension member having a first end coupled to the second end of the linear actuator and a second end configured to be coupled to the subsea structure.

Another embodiment disclosed herein is directed by a method for straightening a bent well. The method comprises (a) securing an anchor to the sea floor. In addition, the method comprises (b) lowing a linear actuator subsea. The linear actuator has a central axis, a first end coupled to the anchor, and a second end opposite the first end. Further, the method comprises (c) coupling the linear actuator to the anchor. Still further, the method comprises (d) coupling a flexible tension member to the linear actuator and a primary conductor of the bent well. The method also comprises (e) actuating the linear actuator to apply tension to the tension member.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
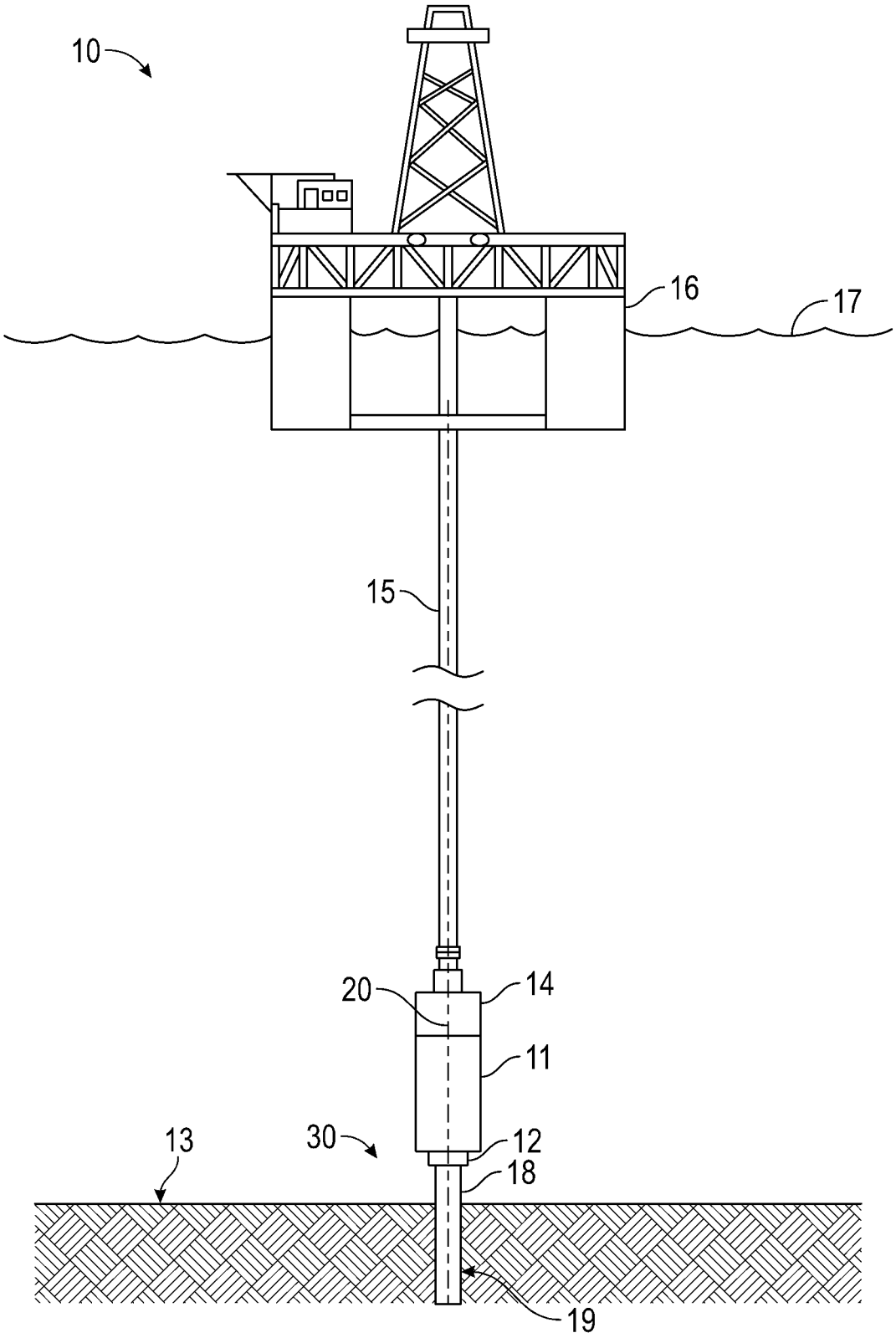
FIG. 1 is a schematic view of an embodiment of an offshore system for drilling and/or production.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

As previously described, if the bending loads and associated stresses applied to a primary conductor exceed the yield strength of the material forming the primary conductor, the primary conductor will plastically deform and become permanently bent (i.e., the primary conductor will not rebound to its vertical orientation when the bending loads decrease). Since the wellhead, BOP, and LMRP are coaxially aligned with the primary conductor, a plastically deformed and bent primary conductor results in the wellhead, BOP, and LMRP being skewed or angled relative to vertical. Installation of remedial devices, such as capping stacks, for controlling and/or capping a damaged subsea well may be further complicated by a skewed BOP or LMRP. In particular, additional tools and processes, as well as added costs and time, may be necessary to (a) properly align a remedial device with the skewed BOP or LMRP, and (b) enable sufficient engagement of the remedial device with the skewed BOP or LMRP.

One approach that has been proposed for rectifying a bent primary conductor is to run a wire rope from a winch on a surface vessel under a sheave disposed at and secured to the sea floor (e.g., with a suction pile), secure the subsea end of the wire rope to the upper portion of the primary conductor exposed above the sea floor, and then apply a tensile load to the wire rope with the winch on the surface vessel to bend the primary conductor back to a vertical orientation. However, there are a couple of potential disadvantages to this approach. For instance, the load applied to the primary conductor with the wire rope must be carefully controlled so as not to damage or excessively over-pull the primary conductor while attempting to bend it back to vertical. This is of particular concern in cases where only a small correction in the angle of the primary conductor relative to vertical is required (e.g., 1-2°). Further, since a bent primary conductor has necessarily experienced plastic deformation (i.e., the yield strength has been exceeded), straightening the primary conductor will require (a) a slight, controlled over-pull and release, thereby allowing it to elastically rebound to vertical, or (b) a pull to vertical and immediate lock of the primary conductor in the vertical orientation to ensure it does not elastically rebound to a non-vertical orientation. For these reasons, the careful monitoring and control of the load applied to the primary conductor with the wire rope is paramount. However, it is difficult to carefully control the tensile load applied to the wire rope mounted to a which on a surface vessel due to heave. In addition, there are risks associated with tying the surface vessel to the primary conductor with wire rope. For instance, if the vessel loses power and drifts, uncontrolled and/or excessive loads may be applied to the primary conductor, the wire rope may break, etc.

Referring now to FIG. 1, an embodiment of an offshore system 10 for drilling and/or producing a subsea well 30 is shown. In this embodiment, system 10 includes a subsea blowout preventer (BOP) 11 mounted to a wellhead 12 at the sea floor 13, and a lower marine riser package (LMRP) 14 connected to the upper end of BOP 11. A marine riser 15 extends from a floating platform 16 at the sea surface 17 to LMRP 14. In general, riser 15 is a large-diameter pipe that connects LMRP 14 to floating platform 16. During drilling operations, riser 15 takes mud returns to platform 16. A primary conductor 18 extends from wellhead 12 into the subterranean wellbore 19. BOP 11, LMRP 14, wellhead 12, and conductor 18 are arranged such that each shares a common central axis 20. In other words, BOP 11, LMRP 14, wellhead 12, and conductor 18 are coaxially aligned. BOP 11, LMRP 14, wellhead 12, and conductor 18 are typically installed such that axis 20 is vertically oriented.

Platform 16 is generally maintained in position over LMRP 14 and BOP 11 with mooring lines and/or a dynamic positioning (DP) system. However, it should be appreciated that platform 16 moves to a limited degree during normal drilling and/or production operations in response to external loads such as wind, waves, currents, etc. Such movements of platform 16 result in the upper end of riser 15, which is secured to platform 16, moving relative to the lower end of riser 15, which is secured to LMRP 14. Wellhead 12, BOP 11 and LMRP 14 are generally fixed in position at the sea floor 13, and thus, riser 15 may flex and pivot about its lower end as platform 16 moves at the surface 17. Consequently, although riser 15 is shown as extending substantially vertically from platform 16 to LMRP 14 in FIG. 1, riser 15 may deviate somewhat from vertical as platform 16 moves at the surface 17.

Figure 2:
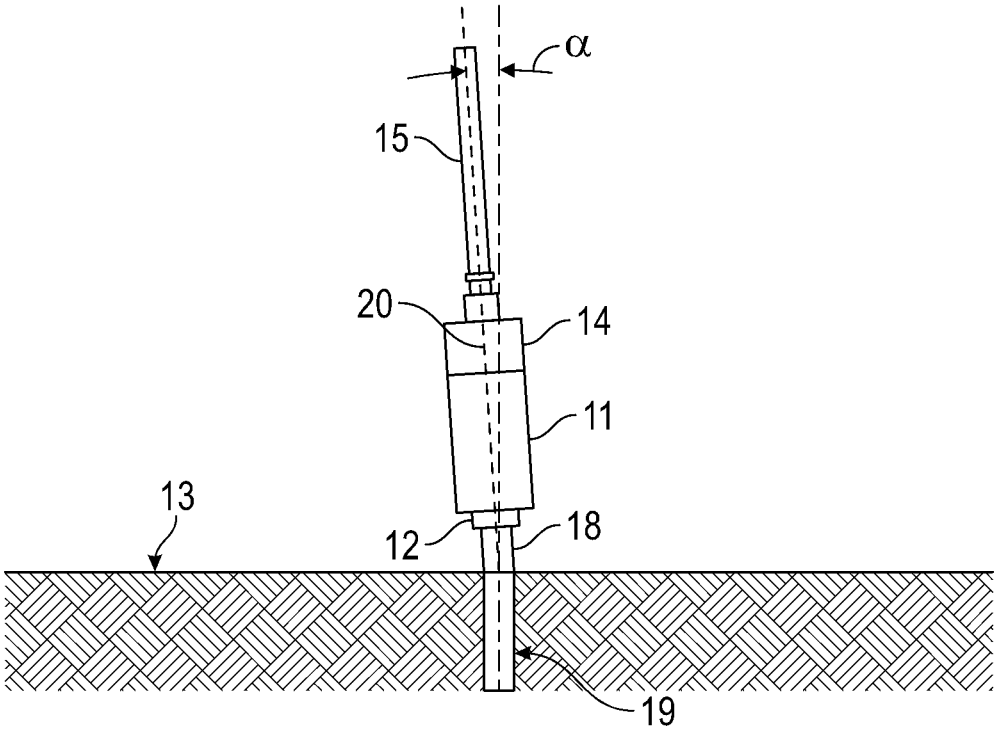
FIG. 2 is a schematic side view of the subsea well of FIG. 1 bent from a vertical orientation by plastic deformation of the primary conductor.

Referring now to FIGS. 1 and 2, as riser 15 pivots from vertical about its lower end, tensile loads are induced in riser 15; with riser 15 skewed from vertical (i.e., disposed at a non-vertical angle), such tensile loads result in the application of lateral loads to LMRP 14, which are transferred to BOP 11 and wellhead 11. Such lateral loads induce stresses in LMRP 14, BOP 11, and wellhead 11. When platform 16 is substantially maintained in position over LMRP 14 and BOP 11 with mooring lines and/or a DP system, such stresses are typically well below the yield strength of the materials forming LMRP 14, BOP 11, and wellhead 11. However, as best shown in FIG. 2, a sufficiently large movement of platform 16 (e.g., during a storm, upon failure of a DP system and/or mooring line(s)) can induce stresses in excess of yield strength of primary conductor 18, thereby plastically deforming and bending conductor 18, and skewing wellhead 12, BOP 11, and LMRP 14 to an angle $\alpha$ relative to vertical.

Referring still to FIG. 2, plastic deformation and bending conductor 18 resulting in a non-zero skew angle $\alpha$ can also result from a blowout. More specifically, BOP 120 and LMRP 140 are configured to controllably seal wellbore 17 and contain hydrocarbon fluids therein. In particular, during a "kick" or surge of formation fluid pressure in wellbore 17, one or more rams of BOP 11 and/or LMRP 14 are normally actuated to seal in wellbore 17. However, if the rams do not seal off wellbore 17, a blowout may occur. Damage from such a blowout may result in conductor 18 being plastically deformed and bent, thereby orienting wellhead 12, BOP 11 and LMRP 14 at non-zero angle $\alpha$ relative to vertical axis 20. As previously described, a non-zero skew angle $\alpha$ is usually undesirable because the landing and installation of remedial devices, such as capping stacks, for controlling and/or capping a damaged subsea well may be further complicated.

Figure 3A:
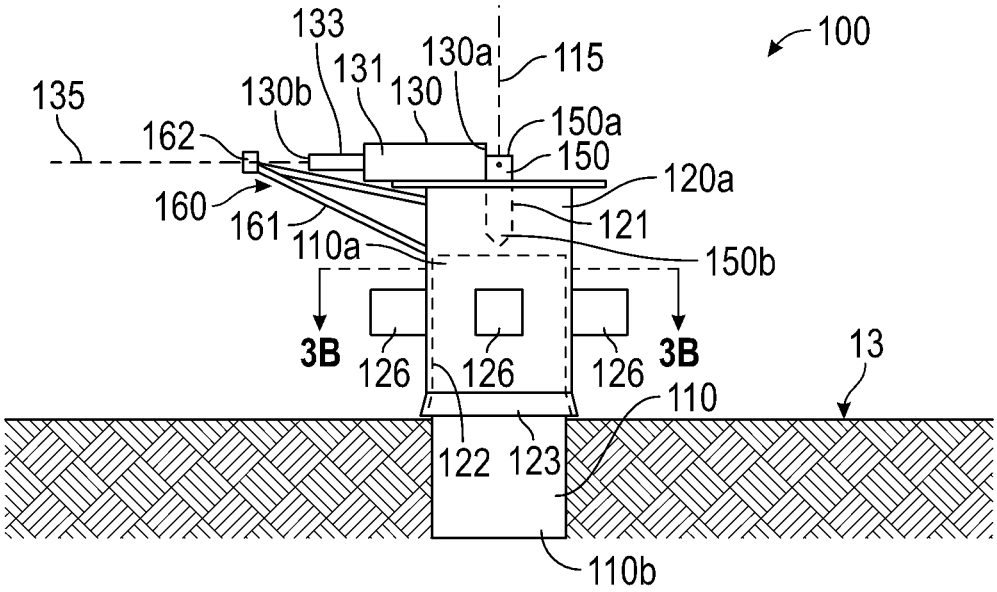
FIG. 3A is a schematic side view of an embodiment of system in accordance with the principles described herein for straightening the bent subsea well of FIG. 2.
Figure 4:
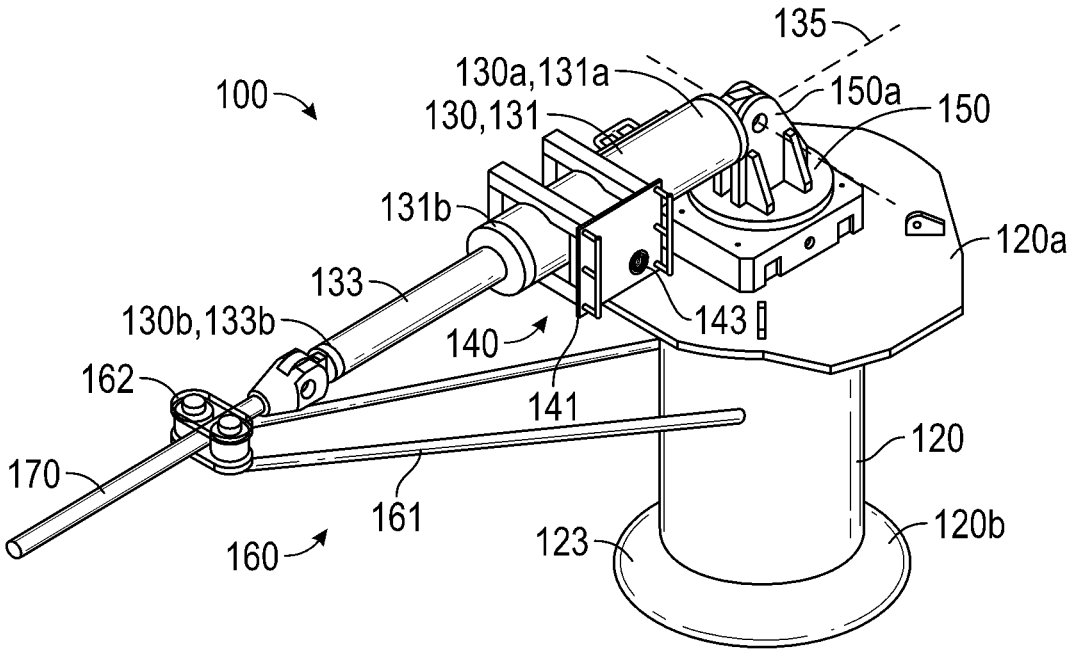
FIG. 4 is an isometric view of the system of FIG. 3A.

Referring now to FIGS. 3A and 4, an embodiment of a system 100 for straightening conductor 18 and moving wellhead 12, BOP 11, and LMRP 14 from non-zero skew angle $\alpha$ to a vertical orientation (i.e., moving axis 20 to a vertical orientation) is shown. In this embodiment, system 100 includes an anchor 110 extending into and secured to the sea bed, an anchor adapter 120 releasably mounted to anchor 110, a linear actuator 130 attached coupled to adapter 120 with a mounting member 150, and a retaining mechanism 160 coupled to adapter 120.

Anchor 110 is an elongate, rigid member fixably disposed in the sea bed. In particular, anchor 110 has a longitudinal axis 115, a first or upper end 110*a* extending upward from the sea floor 13, and a second or lower end 110*b* disposed below the sea floor 13. In this embodiment, anchor 110 is a pile (e.g., suction pile or driven pile) inserted into the sea bed. Anchor 110 is preferably sized, constructed, and inserted to a depth sufficient to resist (without moving) the application of relatively large lateral loads to upper end 110*a* during conductor straightening operations described in more detail below.

Figure 3B:
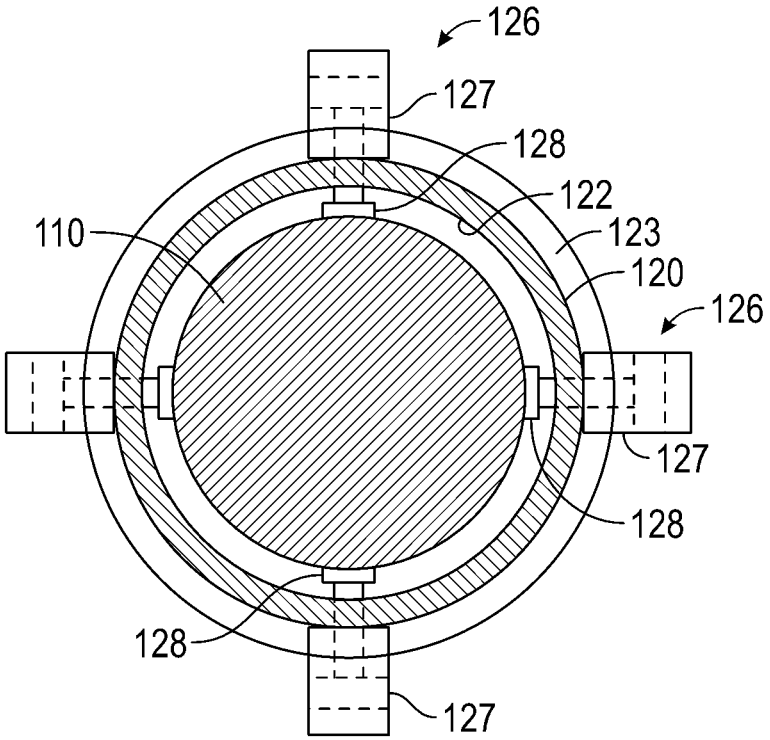
FIG. 3B is a cross-sectional view of the system of FIG. 3A taken along section 3B-3B of FIG. 3A.

Referring still to FIGS. 3A and 4, adapter 120 is coaxially aligned with pile 110 and removably mounted to upper end 110*a*. In particular, adapter 120 is a generally cylindrical inverted bucket having a first or upper end 120*a* and a second or lower end 120*b*. An upper receptacle 121 extends axially from an otherwise closed upper end 120*a* and a lower receptacle 122 extends axially from open lower end 120*b*. Upper receptacle 121 is sized and configured to receive mounting member 150, and lower receptacle 122 is sized and configured to receive upper end 110*a*. More specifically, mounting member 150 is an elongate stabbing pin that is removably disposed and locked within receptacle 121. With member 150 sufficiently seated in receptacle 121, it can be releasably locked therein. In general, mounting member 150 can be releasably locked within receptacle 121 by any means known in the art. In addition, with upper end 110*a* of pile 110 sufficiently seated in receptacle 122, upper end 110*a* can be releasably locked therein. As best shown in FIGS. 3A and 3B, in this embodiment, adapter 120 includes a plurality of circumferentially-spaced rams 126 that can be actuated to engage and disengage upper end 110*a* of pile 110 disposed in receptacle 122 to releasably lock adapter 120 to pile 110. Each ram 126 includes a double-acting linear actuator 127 mounted to adapter 120 between ends 120*a*, 120*b* and a gripping member 128. Each linear actuator 127 extends radially through adapter 120 into receptacle 122; each gripping member 128 is mounted to the radially inner end of each actuator 127 within receptacle 122. Actuators 127 can be actuated to move gripping members 128 radially inward into engagement with pile 110 and actuated to move gripping members 128 radially outward out of engagement with pile 110. In this embodiment, each actuator 126 is an ROV operated hydraulic cylinder. Rams 126 are shown in FIGS. 3A and 3B, but are omitted from FIGS. 4 and 6C-CI.

To facilitate the coaxial alignment of adapter 120 and anchor 110, and the receipt of upper end 110*a* into receptacle 122, an annular funnel 123 is disposed at lower end 120*b*. In this embodiment, adapter 120 is a subsea pile top adapter (PTA) made by Oil States Industries of Arlington, Tex.

Figure 5:
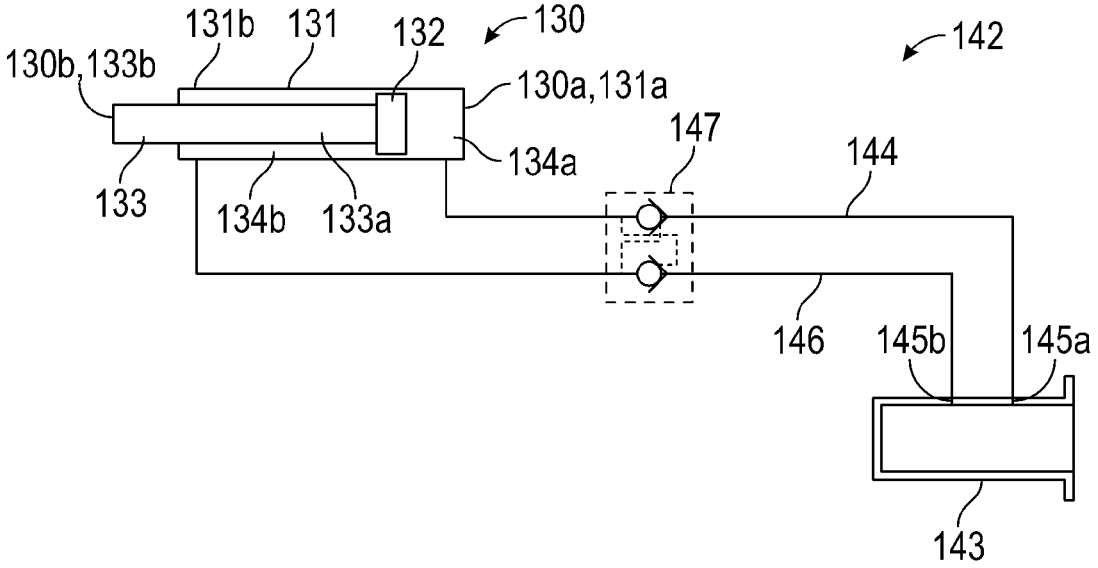
FIG. 5 is a schematic view of hydraulic circuit of the system of FIG. 3A.

Referring now to FIGS. 3A, 4, and 5, linear actuator 130 has a central axis 135, a first end 130*a*, and a second end 130*b*. Actuator 130 is configured to move ends 130*a*, 130*b* axially towards and away from each other. In this embodiment, actuator 130 is a hydraulic piston-cylinder assembly including an outer housing or cylinder 131, a piston 132 movably disposed in cylinder 131, and a rod 133 extending from piston 132 through cylinder 131. Actuator 130 is double-acting, meaning that piston 132 can be hydraulically driven axially through cylinder 131 in either direction. In general, actuator 130 can comprise any suitable double-acting hydraulic actuator known in the art such as the ENERPAC RR-50048 double-acting hydraulic actuator available from ENERPAC Ltd. of Milwaukee, Wis.

Cylinder 131 has a first or pinned end 131*a* defining end 130*a* of actuator 130 and a second or free end 131*b* opposite end 131*a*. In addition, rod 133 has a first or piston end 133*a* secured to piston 132 within cylinder 131 and a second or free end 131*b* extending from cylinder 131 and defining end 130*b* of actuator 130. Within cylinder 131, piston 132 defines a pair of chambers 134*a*, 134*b*—a first chamber 134*a* extends axially from end 130*a*, 131*a* to piston 132 and a second chamber 134*b* extends axially from piston 132 to end 131*b*. Piston 132 is moved through cylinder 131, thereby moving rod 132 relative to cylinder 131, by generating a sufficient pressure differential between chambers 134*a*, 134*b*.

As best shown in FIGS. 4 and 5, an actuator control system 140 is coupled to actuator 130 and provides a mechanism for operating actuator 130 with a subsea ROV. System 140 includes an ROV control panel 141 and a hydraulic circuit 142. In this embodiment, circuit 142 includes an ROV hot stab receptacle 143 in panel 141, a first hydraulic line 144 extending from a first port 145*a* in receptacle 143 to chamber 134*a*, and a second hydraulic line 146 extending from a second port 145*b* in receptacle 143 to chamber 134*b*. In general, an ROV hot stab inserted into receptacle 143 supplies and receives hydraulic pressure from chambers 134*a*, 134*b* via hydraulic lines 144, 146, respectively, and corresponding ports 145*a*, 145*b*. In this embodiment, hot stab receptacle 143 is an API-17H A/B hot stab receptacle. To operate actuator 130 and extend ends 130*a*, 130*b* axially away from each other, hydraulic pressure is supplied to chamber 134*a* via line 144 while hydraulic pressure is simultaneously relieved from chamber 134*b* via line 146; and to operate actuator 130 and retract ends 130*a*, 130*b* axially toward each other, hydraulic pressure is supplied to chamber 134*b* via line 146 while hydraulic pressure is simultaneously relieved from chamber 134*a* via line 144.

In this embodiment, a cross-piloted check valve 147 is provided along lines 144, 146. As is known in the art, a cross-piloted check valve (e.g., cross-piloted check valve 147) enables hydraulic lock piston 132 in both axial directions (i.e., hydraulic pressure cannot be supplied to or relieved from either chamber 134*a*, 134*b*) when hydraulic pressure is not provided to either line 144, 146. In other words, hydraulic pressure must be provided to line 144 and chamber 134*a* for hydraulic pressure to be relieved from chamber 134*b* via line 146, and hydraulic pressure must be provided to line 146 and chamber 134*b* for hydraulic pressure to be relieved from chamber 134*a* via line 144. In addition to, or as an alternative to check valve 147, a manual, ROV operated valve can be positioned in each line 144, 146 to control the flow of hydraulic pressure therethrough.

Referring again to FIGS. 3A and 4, as previously described, actuator 130 is removably coupled to adapter 120 with mounting member 150, which is removably disposed and locked within receptacle 121. Mounting member 150 has an upper end 150*a* extending from receptacle 121 and a lower end 150*b* seated in receptacle 121. Upper end 150*a* comprising a clevis pinned to end 130*a* of actuator 130. Thus, actuator 130 can pivot in a vertical plane about end 130*a* relative to mounting member 150. The opposite end 130*b* of actuator is pinned to a clevis provided on the end of a flexible tension member 170. Thus, actuator 130 can pivot about in a vertical plane about end 130*b* relative to tension member 170. As will be described in more detail below, during conductor straightening operations, tension member 170 is coupled to the upper end of conductor 18 and tension is applied to member 170 with actuator 130 to reduce angle $\alpha$ to zero (or near zero) and bend conductor 18 back to a vertical (within a desired tolerance) orientation. In this embodiment, tension member 170 is a wire rope. However, in other embodiments, tension member 170 can comprise other flexible members capable of withstanding and transferring relatively large tensile loads such as chain or synthetic rope (e.g., neutrally buoyant synthetic rope).

Referring still to FIGS. 3A and 4, retaining mechanism 160 provides a means to prevent the inadvertent and/or abrupt release of tension applied to member 170. Retaining mechanism 160 includes a rigid frame 161 rigidly fixed and secured to adapter 120 and a cam cleat 162 attached to frame 161 distal adapter 120. Tension member 170 extends through cam cleat 162, which allows tension member 170 to move therethrough in one direction (to the right in FIG. 3A) and prevents tension member 170 from moving therethrough in the opposite direction (to the left in FIG. 3A).

To straighten primary conductor 18 and move wellhead 12, BOP 11, and LMRP 14 back to the vertical orientation, system 100 is deployed and installed subsea, and then employed to apply a lateral load to the upper end of primary conductor 18 proximal wellhead 12 with tension member 170. In FIGS. 6A-6F, system 100 is shown being deployed and installed subsea, and in FIGS. 6G-6I, system 100 is shown being used to apply a lateral load to the upper end of primary conductor 18 proximal wellhead 12 with tension member 170.

Figure 6A:
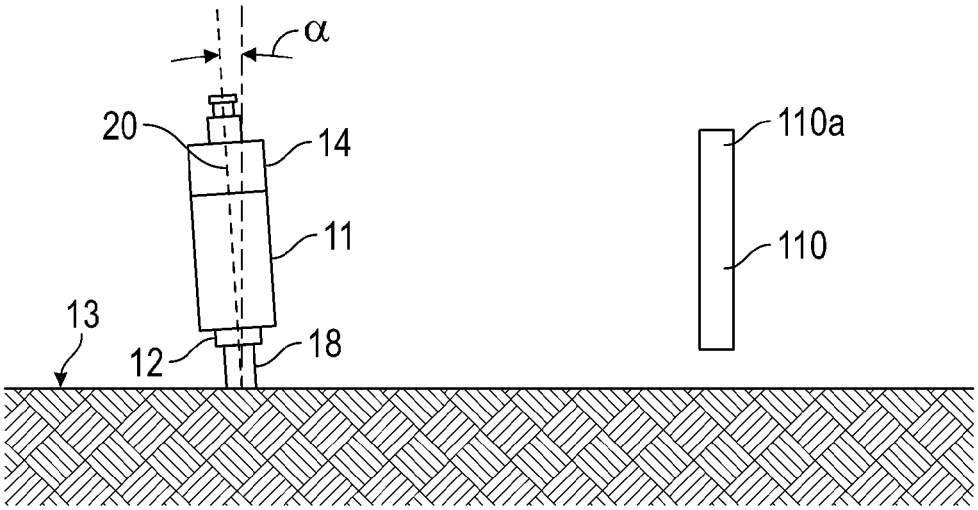
FIGS. 6A-6F are sequential schematic side views of the system of FIG. 3A being deployed and installed subsea.
Figure 6B:
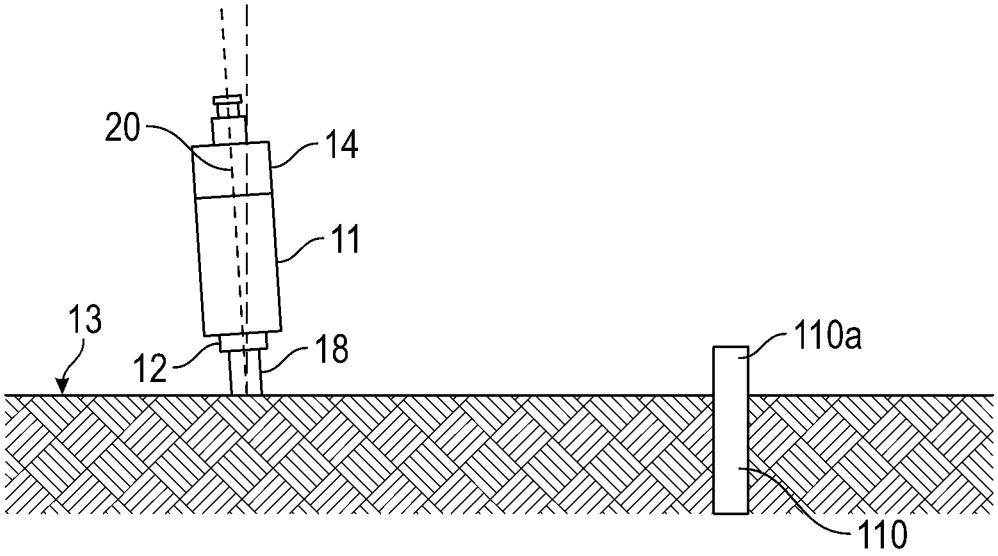
Figure 6C:
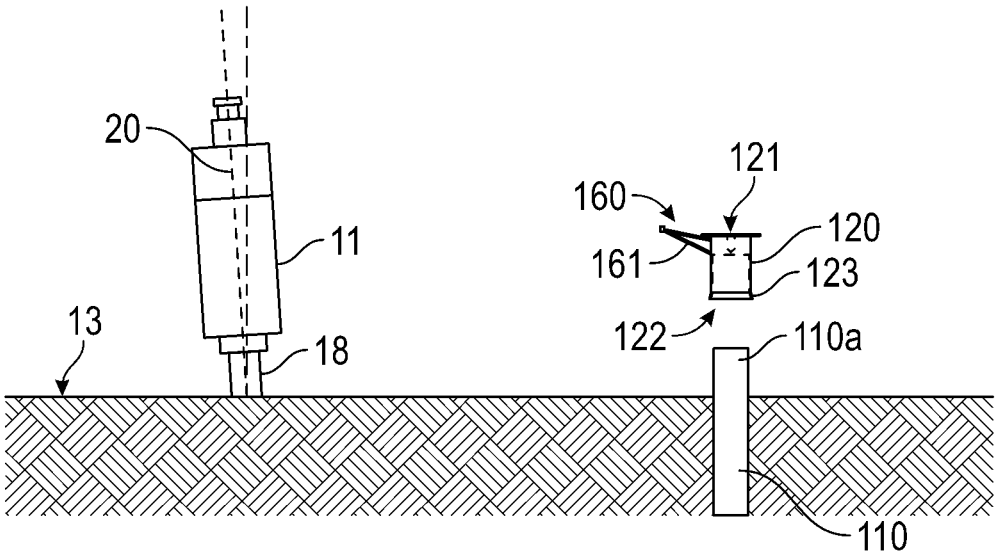
Figure 6D:
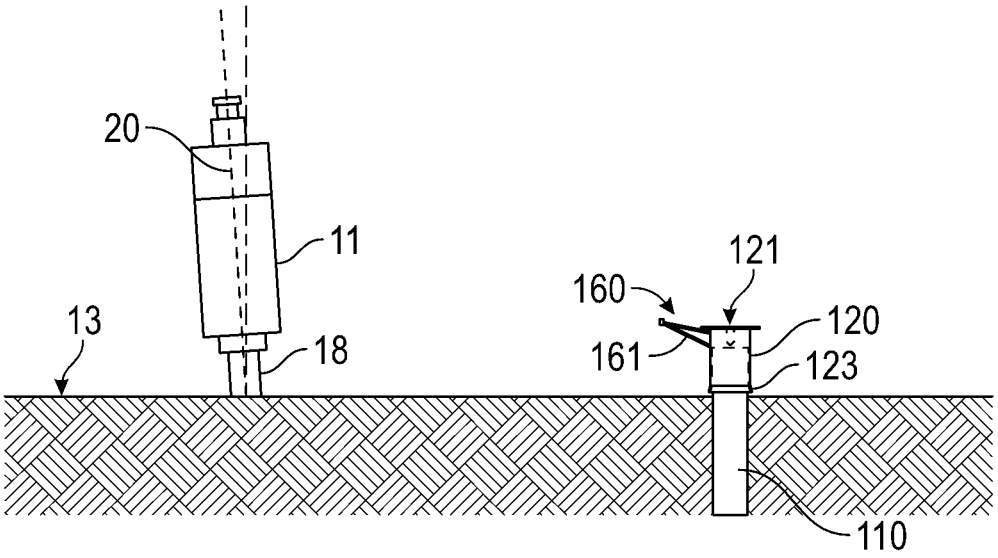
Figure 6E:
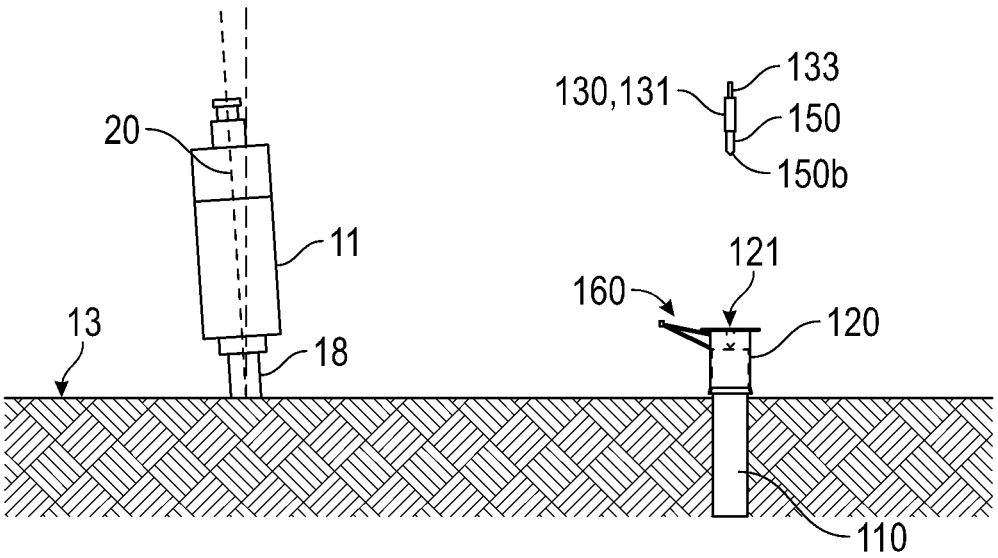
Figure 6F:
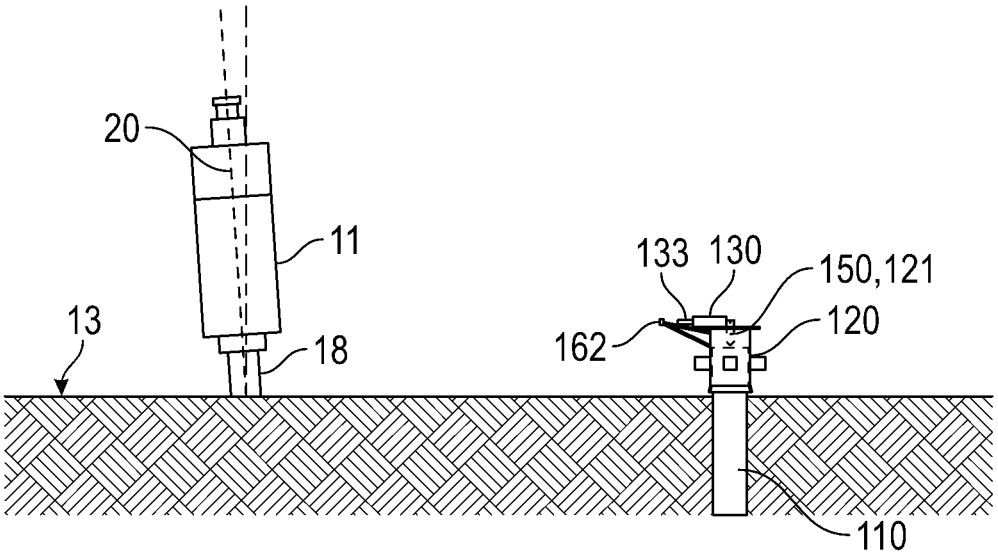

Referring now to FIGS. 6A-6F, in this embodiment, system 100 is deployed and installed in stages. System 100 is preferably installed subsea at a location that is diametrically opposed (i.e., 180° from) the direction to which wellhead 12, BOP 11, and LMRP 14 are leaning. First, anchor 110 is lowered subsea and inserted (e.g., driven or via suction) into the sea floor 13 in a vertical orientation as shown in FIGS. 6A and 6B. Upper end 110*a* of anchor 110 remains positioned above the sea floor 13. Next, as shown in FIGS. 6C and 6D, adapter 120, with retaining mechanism 160 attached thereto and gripping members 128 radially withdrawn with actuators 127, is lowered subsea. Receptacle 122 is generally coaxially aligned with anchor 110 as adapter 120 is lowered onto upper end 110*a*. Funnel 123 aids in guiding adapter 120 to coaxial alignment with anchor 110 as it is lowered onto upper end 110*a*. With end 110*a* sufficiently seated in receptacle 122, adapter 120 is locked onto anchor 110 with rams 126. Moving now to FIGS. 6E and 6F, actuator 130, with mounting member 150 coupled thereto, is lowered subsea. Due to the pinned connection between actuator 130 and mounting member 150, actuator 130 and mounting member 150 are generally vertically oriented when lowered subsea suspended from end 133*b*. Mounting member 150 is generally coaxially aligned with receptacle 121 as member 150 is lowered into receptacle 122. With member 150 sufficiently seated in receptacle 121, member 150 is locked therein, and then actuator 130 is pivoted about end 130*a* (relative to member 150) to a substantially horizontal orientation. Although actuator 130 is deployed and installed with mounting member 150 in this embodiment, in other embodiments, mounting member 150 can be deployed and installed in receptacle 121 followed by deployment and coupling of actuator 130 to mounting member 150.

Figure 6G:
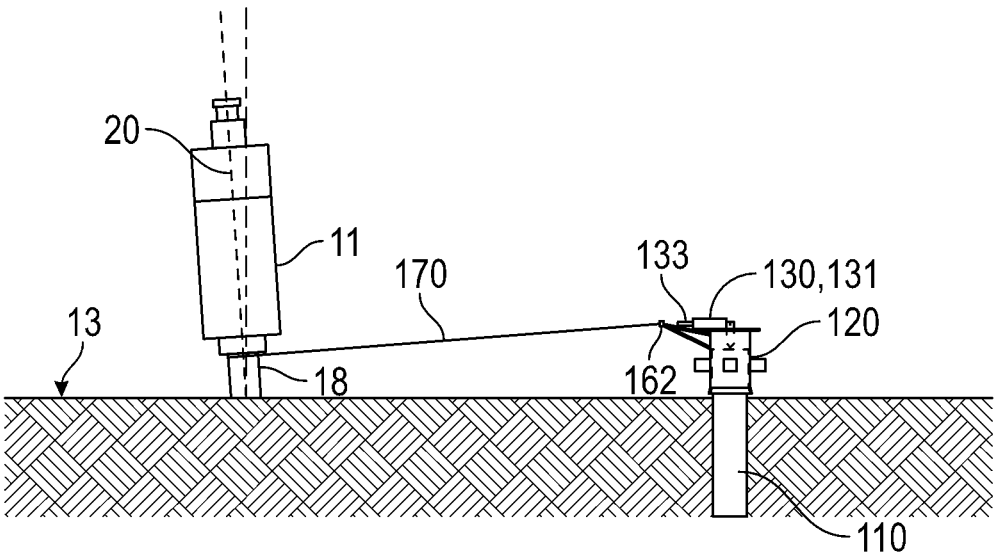
FIGS. 6G-6I are sequential schematic side views of the system of FIG. 3 being used to straighten the bent well of FIG. 2.
Figure 6H:
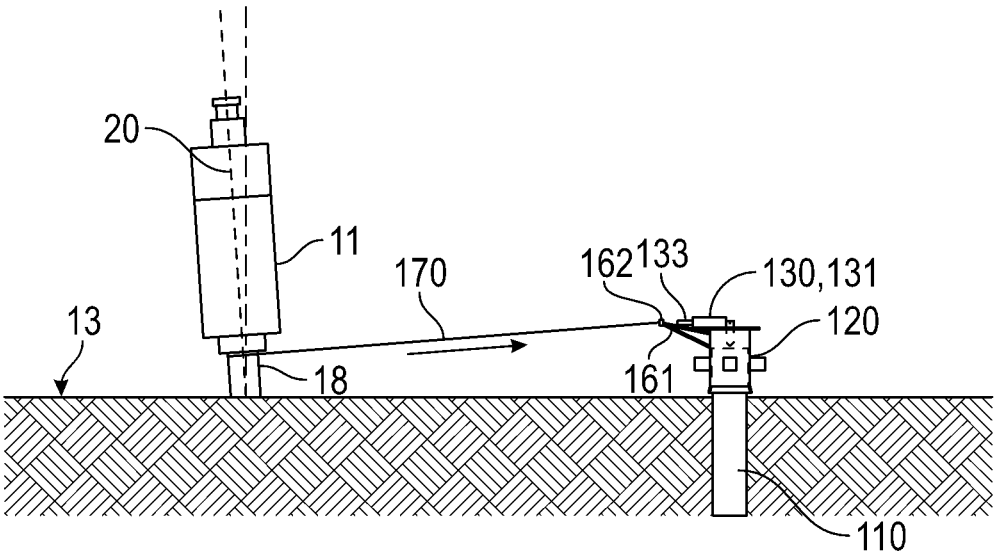
Figure 6I:
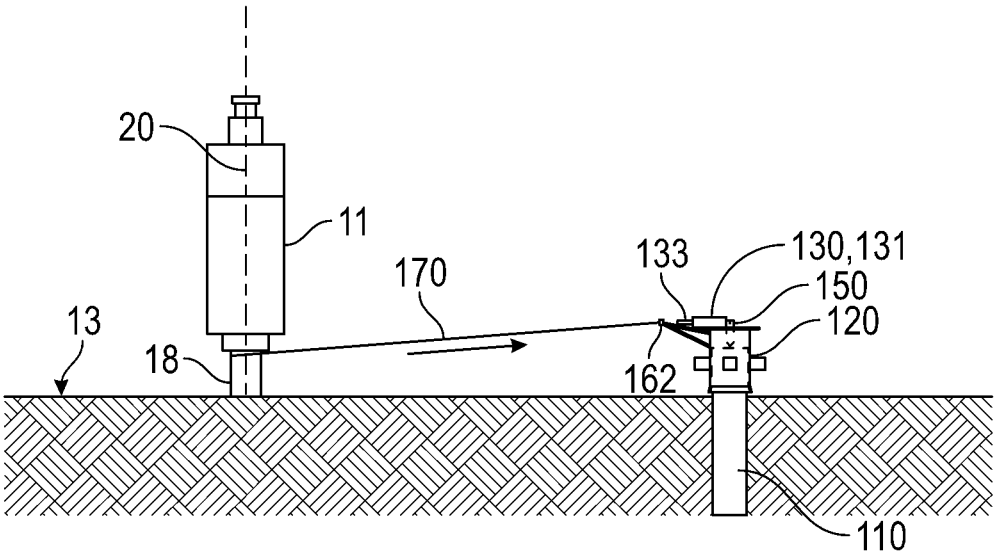

Referring now to FIGS. 6G-6I, to straighten conductor 18, tension member 170 is coupled to conductor 18 and actuator 130, and tension is applied to tension member 170 with actuator 130. In particular, with rod 133 fully extended from cylinder 131, one end of tension member 170 is coupled to the upper end of primary conductor 18 and the opposite end of tension member 170 is coupled to end 133*b* of rod 133 as shown in FIG. 6G. Tension member 170 is preferably installed such that it is taut or slightly taut between actuator 130 and conductor 18 with rod 133 fully extended from cylinder 131. Actuator 130 can be deployed and installed with rod 133 fully extended, or a subsea ROV can be employed to sufficiently extend rod 133 by inserting a hot stab into hot stab receptacle 143 and supplying hydraulic pressure to chamber 134*a* via port 145*a* and line 144, while simultaneously relieving hydraulic pressure from chamber 134*b* via line 146 and port 145*b* to increase the volume of chamber 134*a*, decrease the volume of chamber 134*b*, and move piston 132 axially through cylinder 132 away from end 130*a* Next, a subsea ROV inserts a hot stab into hot stab receptacle 143 (if not already done to extend rod 133), and supplies hydraulic pressure to chamber 134*b* via port 145*b* and line 146, while simultaneously relieving hydraulic pressure from chamber 134*a* via line 144 and port 145*a* to increase the volume of chamber 134*b*, decrease the volume of chamber 134*a*, and move piston 132 axially through cylinder 132 towards end 130*a*. With tension member 170 taut, movement of piston 132 towards end 130*a* applies a tensile load to tension member 170, which applies a lateral load to primary conductor 18. The tension in member 170 and corresponding lateral load applied to primary conductor 18 are increased until conductor 18 is slowly pulled to vertical (within a desired tolerance) as shown in FIGS. 6H and 6I. An inclinometer is preferably attached to conductor 18, BOP 11, or LMRP 14 to indicate when the vertical orientation (within the desired tolerance) is achieved.

Conductor 18 can be bent to vertical without plastically deforming conductor 18, and then held in the vertical orientation by locking tension member 170 in place (e.g., via hydraulic lock of actuator 130 and/or cam cleat 162) to prevent conductor 18 from rebounding back to the bent orientation. Alternatively, conductor 18 can be bent sufficiently beyond vertical and plastically deformed such that conductor 18 will rebound to the vertical orientation once cam cleat 162 is opened and tension in member 170 is released.

Figure 7:
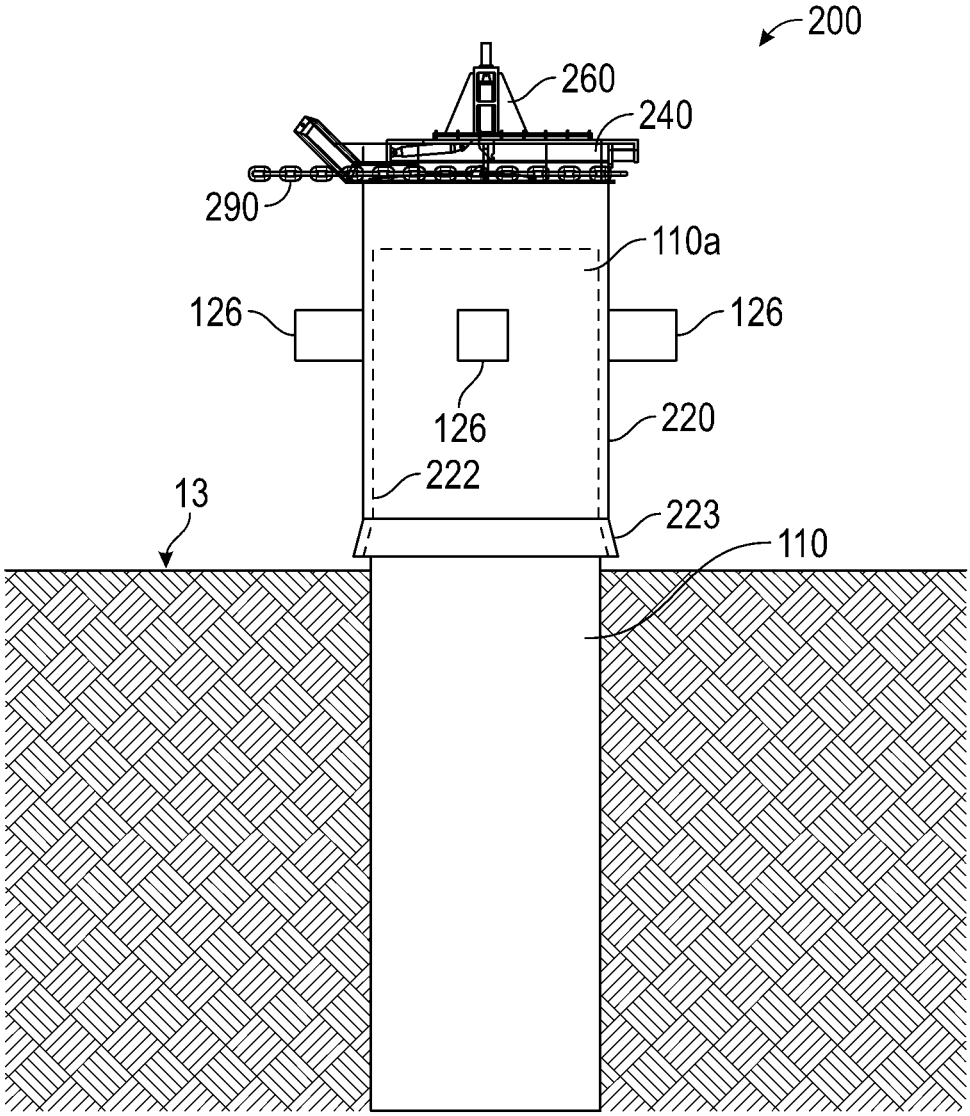
FIG. 7 is a schematic side view of an embodiment of system in accordance with the principles described herein for straightening the bent subsea well of FIG. 2.

Referring now to FIG. 7, an embodiment of a system 200 for straightening conductor 18 and moving wellhead 12, BOP 11, and LMRP 14 from non-zero skew angle $\alpha$ to a vertical orientation aligned with axis 20 is shown. In this embodiment, system 200 includes an anchor 110 as previously described extending into and secured to the sea bed, an anchor adapter 220 releasably mounted to anchor 110, an adapter interface assembly 240 secured to adapter 220, and a tension assembly 260 coupled to interface assembly 240. As will be described in more detail below, tension assembly 260 applies tensile loads to a flexible tension member 290, which exerts lateral loads on the upper end of conductor 18 to pull it to a vertical orientation. In this embodiment, tension member 290 is a chain, and thus, may also be referred to as chain 290.

Figure 10:
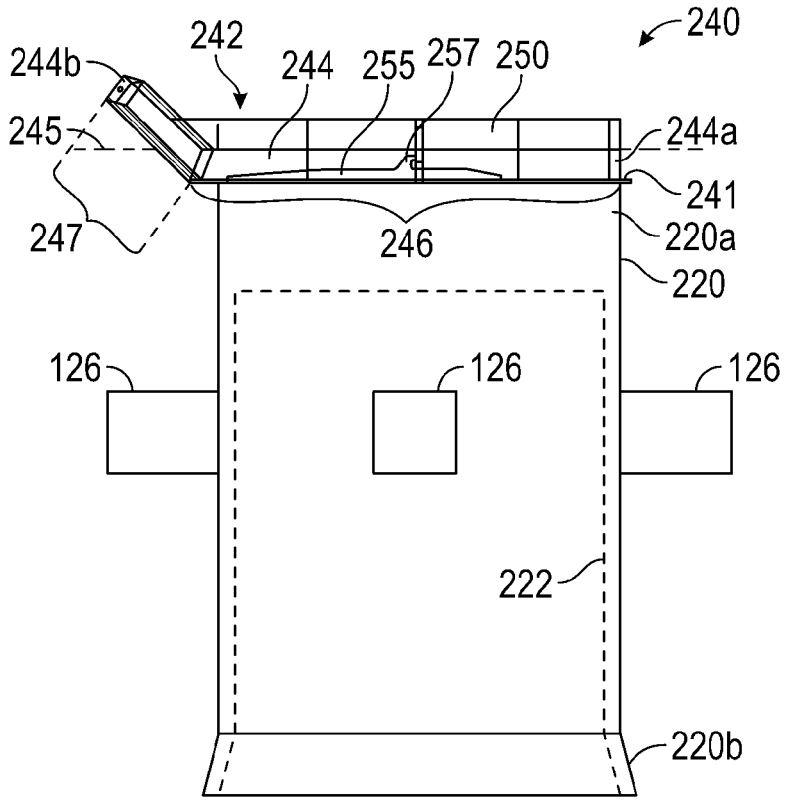
FIG. 10 is a schematic side view of the adapter and adapter interface assembly of FIG. 7.

Referring now to FIGS. 7 and 10, adapter 220 is coaxially aligned with pile 110 and removably mounted to upper end 110*a*. Adapter 220 is substantially the same as adapter 120 previously described. In particular, adapter 220 is a generally cylindrical inverted bucket having a first or upper end 220*a* and a second or lower end 220*b*. A lower receptacle 222 extends axially from open lower end 220*b*. Lower receptacle 222 is sized and configured to receive upper end 110*a*. With upper end 110*a* sufficiently seated in receptacle 222, a plurality of circumferentially-spaced rams 126, as previously described, can be actuated to engage and disengage upper end 110*a* of pile 110 disposed in receptacle 222 to releasably lock adapter 220 to pile 110. In this embodiment, four uniformly circumferentially-spaced rams 126 are provided on adapter 220. Rams 126 are shown in FIGS. 7 and 10, but are omitted from FIGS. 18C-18I.

To facilitate the coaxial alignment of adapter 220 and anchor 110, and the receipt of upper end 110*a* into receptacle 222, an annular funnel 223 is disposed at lower end 220*b*.

However, unlike adapter 120 previously described, in this embodiment, adapter 220 does not include a receptacle in its upper end 220*a*. In this embodiment, adapter 220 is a subsea pile top adapter (PTA) made by Oil States Industries of Arlington, Tex.

Figure 11:
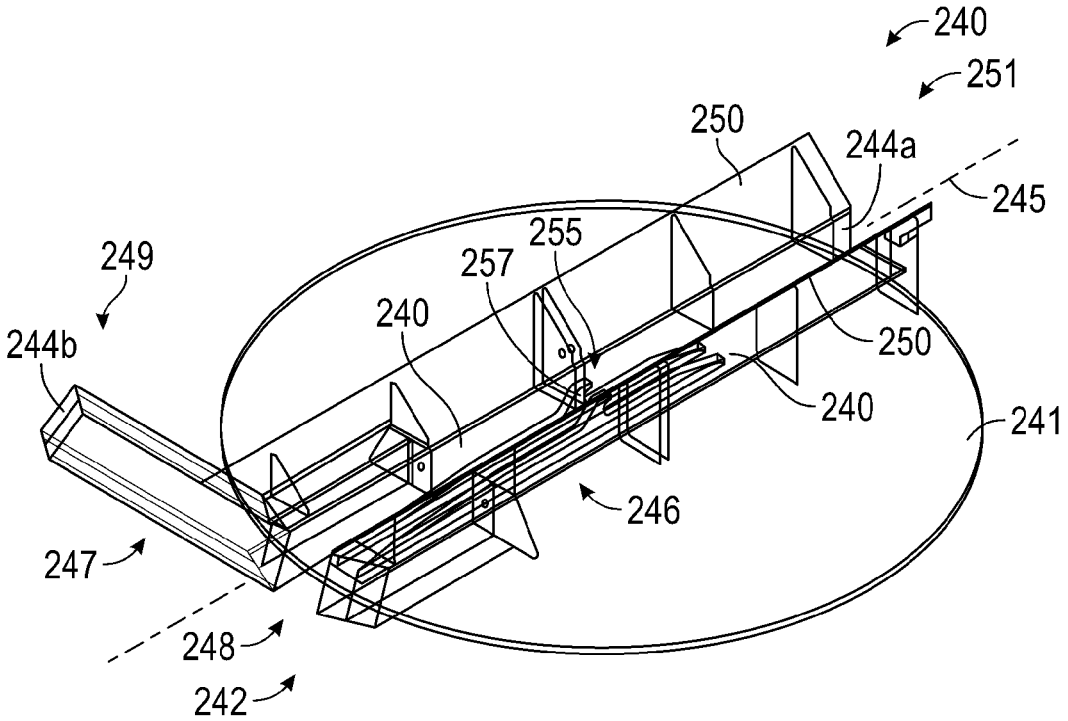
FIG. 11 is an isometric view of the adapter interface assembly of FIG. 7.

Referring now to FIGS. 10 and 11, interface assembly 240 includes a base plate 241, a guide assembly 242 coupled to base plate 241, and a chain grab or retainer 255 coupled to base plate 241. Base plate 241 is secured to upper end 220*a* of adapter 220, thereby attaching interface assembly 240 thereto. Base plate 241, and hence interface assembly 240, is preferably removably secured to adapter 220. In this embodiment, base plate 241 is bolted to upper end 220*a* of adapter 220. In other embodiments, the base plate (e.g., base plate 241), and hence the interface assembly (e.g., interface assembly 240) is fixably secured to the adapter (e.g., adapter 220) such as via welding.

As previously described, base plate 241 is removably secured to adapter 220, and adapter 220 is removably secured to anchor 110. Thus, adapter 220 and interface assembly 240 can be reused with different anchors (e.g., at different subsea locations).

Guide assembly 242 is attached to base plate 241 and has a longitudinal axis 245. In this embodiment, guide assembly 242 includes a pair of elongate chain guides 244 and a pair of elongate tension assembly guide plates 250 extending from chain guides 244. Each chain guide 244 has a first end 244*a*, a second end 244*b* opposite first end 244*a*, a first section 246 extending axially from end 244*a* across base plate 241, and a second linear section 247 extending from section 246 to end 244*b*. Sections 246 comprise parallel, laterally spaced vertical walls extending perpendicularly from plate 241. An elongate generally rectangular recess 248 is formed between sections 246. Recess 248 is sized to receive chain 290 and allow chain 290 to move therethrough. Moving from sections 246 to ends 244*b*, sections 247 extend upward and outward away from each other, thereby generally defining a funnel 249 that facilitates the guidance of chain 290 into recess 248 as it is pulled by system 200.

Tension assembly guide plates 250 extend axially along sections 246 from ends 244*a* to sections 247. In addition, guide plates 250 taper away from each other moving upward from sections 246, thereby defining an elongate generally V-shaped receptacle 251 immediately above recess 248. As will be described in more detail below, tension assembly 260 is seated in mating receptacle 251 and slidingly engages guide plates 250.

Figure 9:
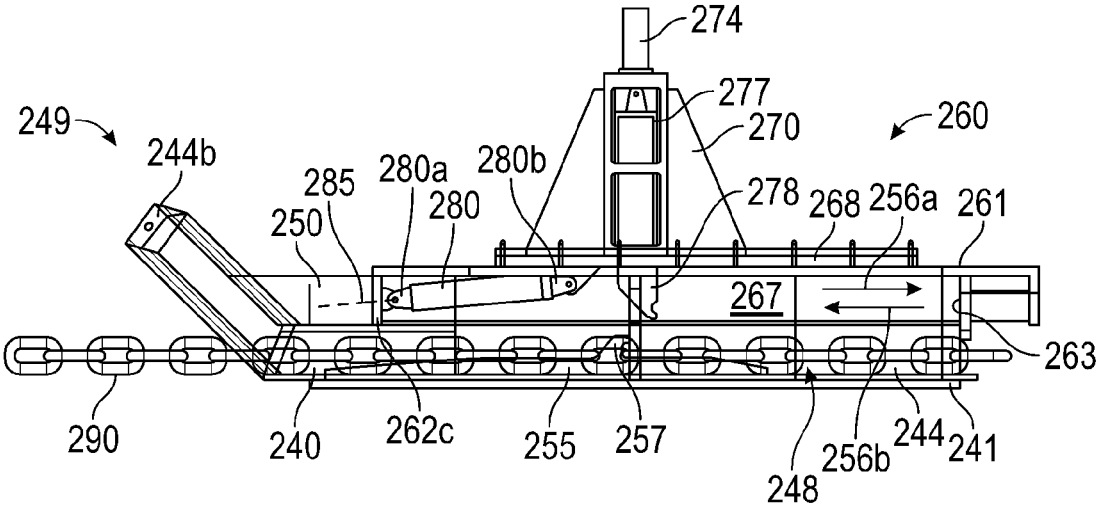
FIG. 9 is a side view of the system of FIG. 7.

As best shown in FIGS. 9-11, grab 255 is secured to base plate 241 in recess 248 and between chain guides 244. Grab 255 allows chain 290 to move through recess 248 in a first direction 256*a*, but positively engages and grasps tension member 290 when it seeks to move in a second direction 256*b* opposite direction 256*a*. In this embodiment, grab 255 comprises a pair of laterally spaced claws 257 facing end 244*a*. Thus, chain 290 can slide over claws 257 in direction 256*a*, but is positively engaged by claws 257 when chain 290 seeks to move in direction 256*b*.

Figure 8:
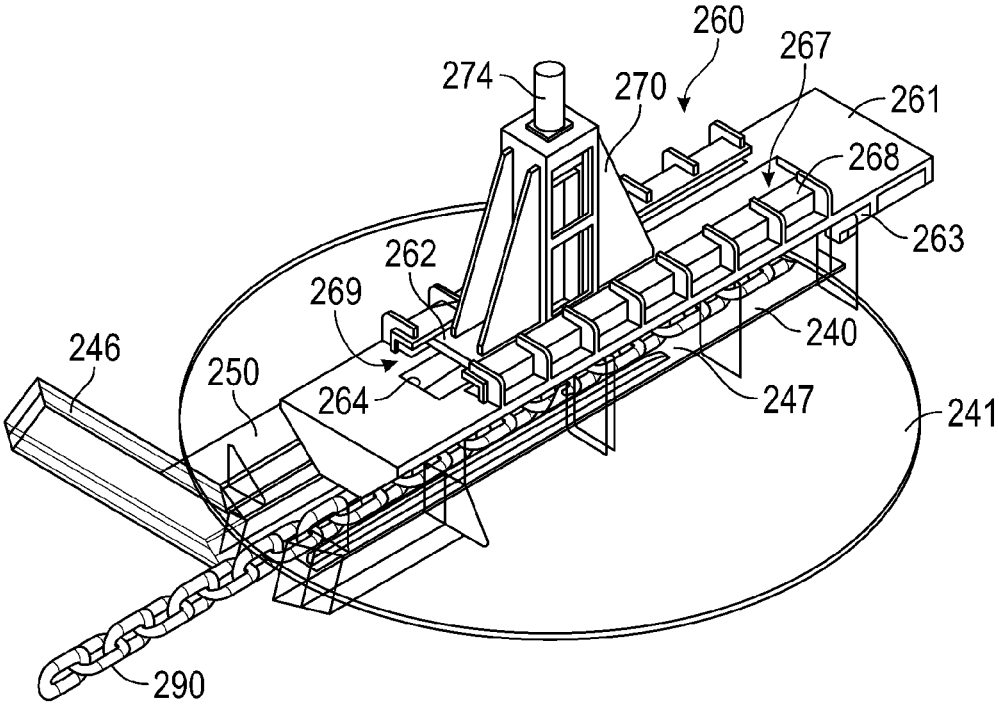
FIG. 8 is an isometric view of the system of FIG. 7.
Figure 12:
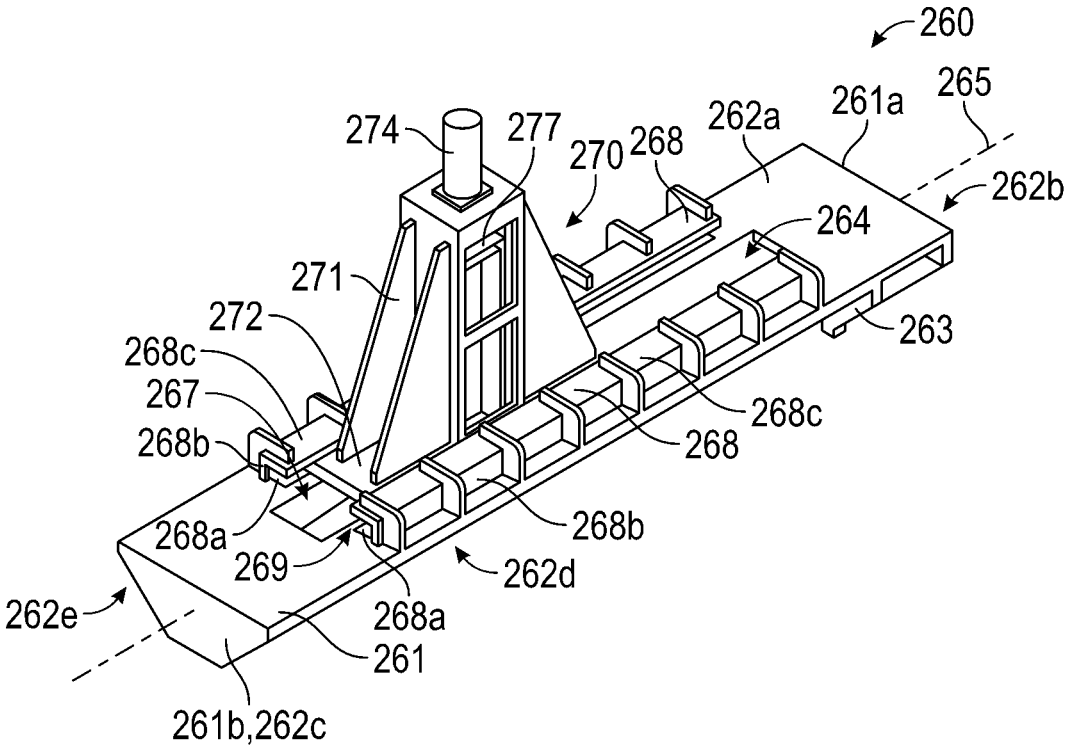
FIG. 12 is an isometric view of the tension assembly of FIG. 7.

Referring now to FIGS. 8, 9, and 12, tension assembly 260 applies tensile loads to chain 290. In this embodiment, tension assembly 260 includes an elongate base 261 and a traveling assembly 270 moveably coupled to base 261.

Figure 13:
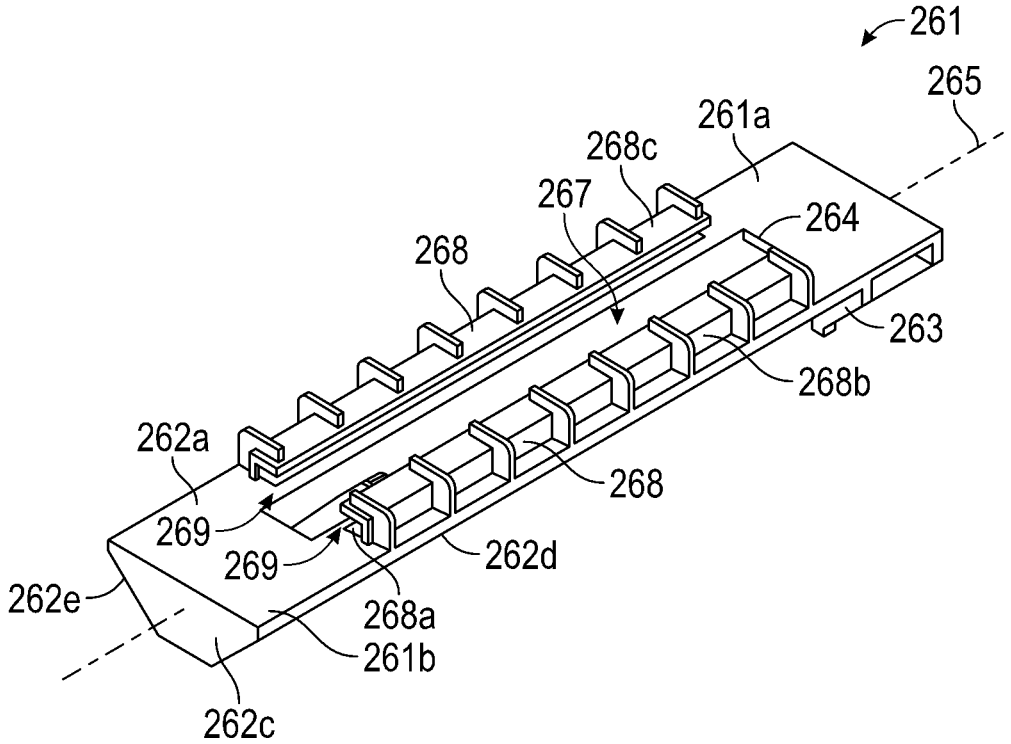
FIG. 13 is an isometric view of the base of the tension assembly of FIG. 12.
Figure 14:
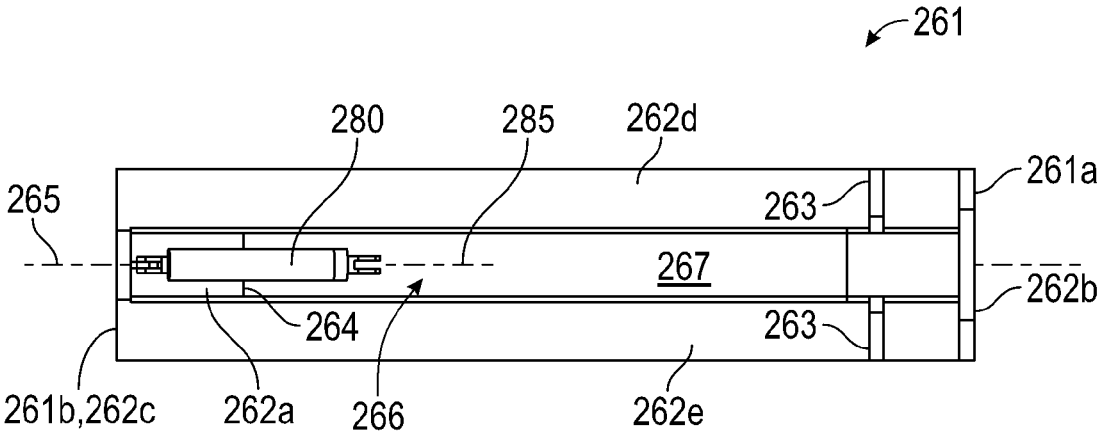
FIG. 14 is a bottom view of the base of the tension assembly of FIG. 12.

As best shown in FIGS. 12-14, base 261 has a central or longitudinal axis 265, a first end 261*a*, and a second end 261*b* opposite end 261*a*. In addition, base 261 includes a prismatic generally V-shaped body 262 and a pair of laterally spaced, parallel guide rails 268 mounted thereto. Body 262 comprises a horizontal top plate 262*a*, a pair of vertical end plates 262*b*, 262*c*, and a pair of lateral side plates 262*d*, 262*e*. End plates 262*b*, 262*c* extend perpendicularly from top plate 262*a* at ends 261*a*, 261*b*, respectively. Side plates 262*d*, 262*e* extending downward and laterally inward from top plate 262*a*, and extend axially between end plates 262*b*, 262*c*. Thus, side plates 262*d*, 262*e* taper inward towards each other moving away from top plate 262*a*. Each side plate 262*d*, 262*e* includes a shoulder 263 proximal end 261*a*. As best shown in FIGS. 8 and 9, when tension assembly 260 is seated in receptacle 251, plates 262*d*, 262*e* slidingly engage mating tapered guide plates 250 previously described and shoulders 262 axially abut ends 244*a*.

Referring again to FIGS. 12-14, top plate 262*a* includes an elongate rectangular opening 264 extending therethrough, and as best shown in FIG. 14, an opening 266 is provided in the bottom of body 262 between end plates 262*b*, 262*c*. Openings 264, 266 are oriented parallel to axis 265 and provide access to an inner cavity 267 of body 262 disposed between plates 262*a*, 262*b*, 262*c*, 262*d*, 262*e*.

Referring again to FIGS. 12, and 13, guide rails 268 are mounted to top plate 262*a* on opposite sides of opening 264, and extend axially along the length of opening 264. In this embodiment, each rail 268 includes a horizontal base section 268*a* secured to top plate 262*a*, a vertical section 268*b* extending vertically upward from the laterally outer edge of base section 268*a*, and a horizontal section 268*c* extending laterally inward from the upper end of vertical section 268*b*. The general C-shape of each guide rail 268 results in an elongate slot 269 disposed between each pair of sections 268*a*, 268*c*.

Referring now to FIGS. 12 and 15-17, traveling assembly 270 includes a support frame 271, a linear actuator 274, a chain grab or retainer 278, and a connection member 277 extending from actuator 274 to grab 278. Frame 271 includes a rectangular base plate 272 and a pair of elongate, parallel bearing walls 273 extending perpendicularly upward from base plate 272. Base plate 272 is disposed in slots 269 and slidingly engaging guide rails 268 as best shown in FIG. 12.

Figure 15:
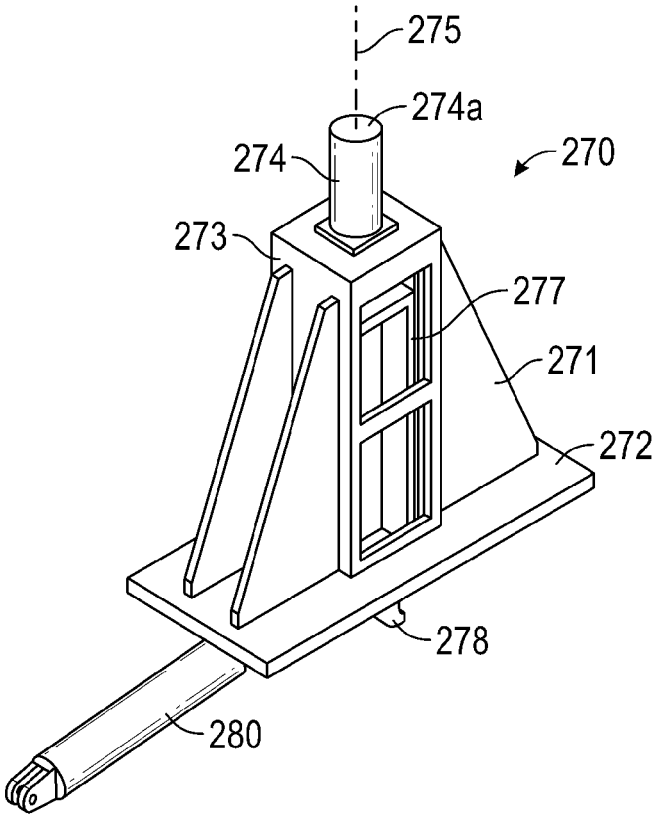
FIG. 15 is an isometric view of the traveling assembly of the tension assembly of FIG. 12.
Figure 16:
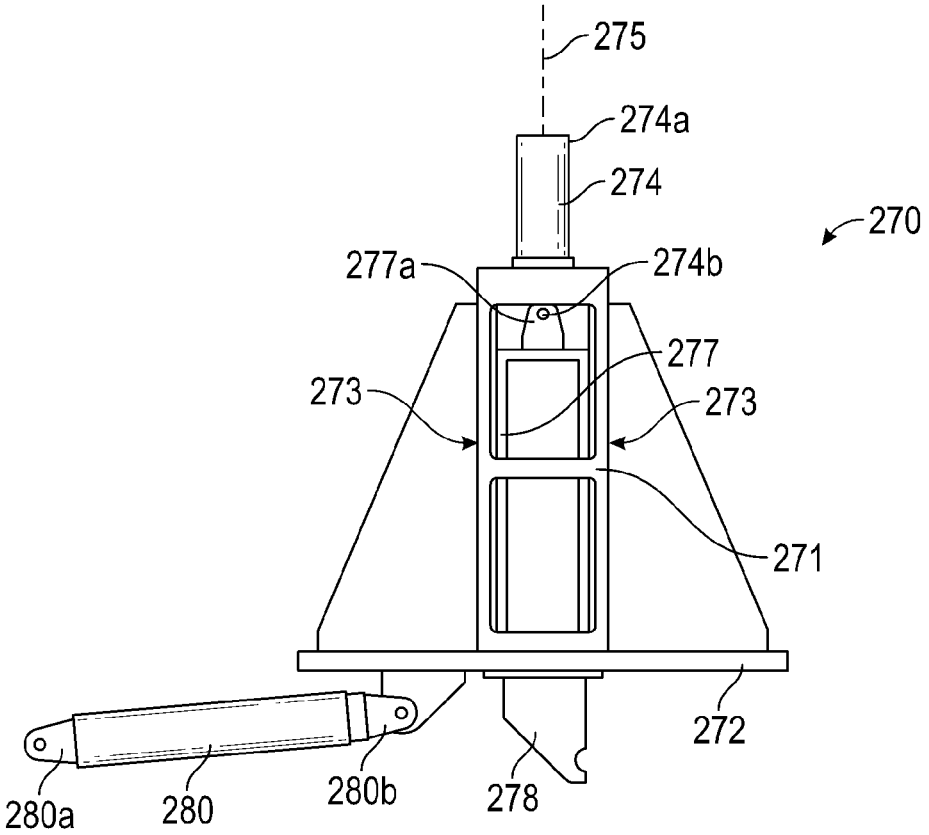
FIG. 16 is a side view of the traveling assembly of the tension assembly of FIG. 12.
Figure 17:
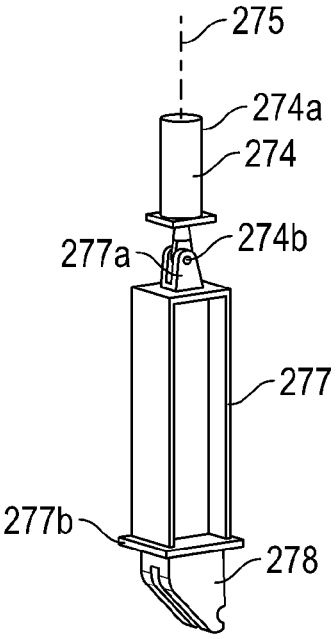
FIG. 17 is an isometric view of the linear actuator, the connection member, and the retainer of the traveling assembly of FIG. 15.

Referring now to FIGS. 15-17, linear actuator 274 is attached to the upper ends of walls 273 and has a vertically oriented central axis 275, a first or upper end 274*a*, and a second or lower end 274*b*. Actuator 274 is configured to move ends 274*a*, 274*b* axially towards and away from each other. In this embodiment, actuator 274 is a double-acting hydraulic piston-cylinder assembly.

Connection member 277 is positioned between bearing walls 273 and has a first or upper end 277*a* coupled to lower end 274*b* of actuator 274 and a second or lower end 277*b* coupled to grab 278. Lower end 277*b* sized and positioned to extend through opening 264 in top plate 262*a* when traveling assembly 270 is coupled thereto. Actuator 274 can move connection member 277 and grab 278 vertically up and down within frame 271. More specifically, actuator 274 can move grab 278 vertically between cavity 267 above chain 290 and recess 248 containing chain 290 when traveling assembly 270 is coupled thereto.

Referring now to FIG. 9, grab 278 is oriented similar to grab 255. In particular, grab 278 is oriented to prevent chain 290 from moving through recess 248 in second direction 256*b* when grab 278 is disposed in recess 248 and positively engages chain 290.

Referring still to FIG. 9, a linear actuator 280 is positioned in cavity 267 of body 262 and has a central axis 285, a first end 280*a* coupled to end plate 262*b*, and a second end 280*b* coupled to base plate 272. Actuator 280 is configured to move ends 280*a*, 280*b* axially towards and away from each other. In this embodiment, actuator 280 is a double-acting hydraulic piston-cylinder assembly. Thus, by extending actuator 280 (i.e., moving ends 280*a*, 280*b* apart), traveling assembly 270 is moved in direction 256*a* relative to base 261 and interface assembly 240, and by retracting actuator 280 (i.e., moving ends 280*a*, 280*b* toward each other), traveling assembly 270 is moved in direction 256*b* relative to base 261 and interface assembly 240.

To straighten primary conductor 18 and move wellhead 12, BOP 11, and LMRP 14 back to the vertical orientation, system 200 is deployed and installed subsea, and then employed to apply a lateral load to the upper end of primary conductor 18 proximal wellhead 12 with tension member 290. In FIGS. 18A-18G, system 200 is shown being deployed and installed subsea, and in FIGS. 18H and 18I, system 200 is shown being used to apply a lateral load to the upper end of primary conductor 18 proximal wellhead 12 with tension member 290.

Figure 18A:
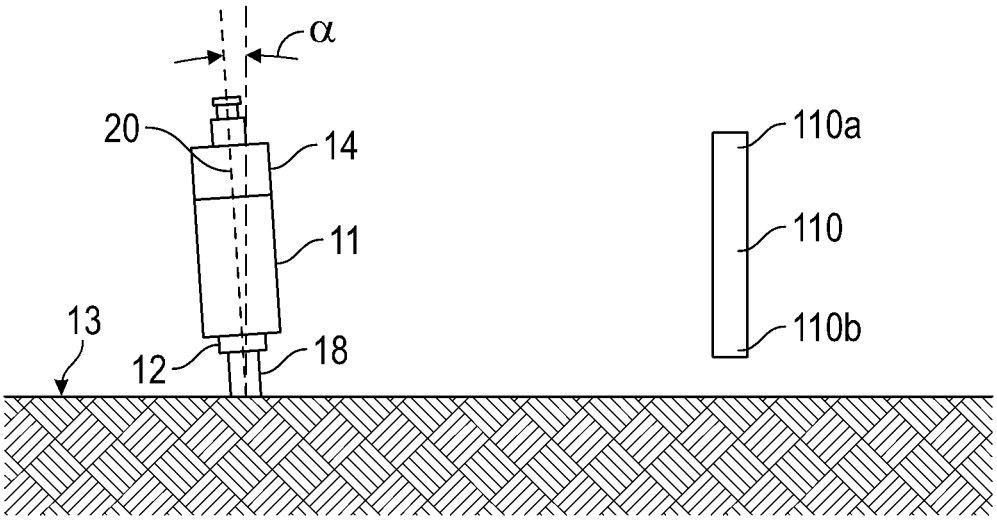
FIGS. 18A-18G are sequential schematic side views of the system of FIG. 7 being deployed and installed subsea.
Figure 18B:
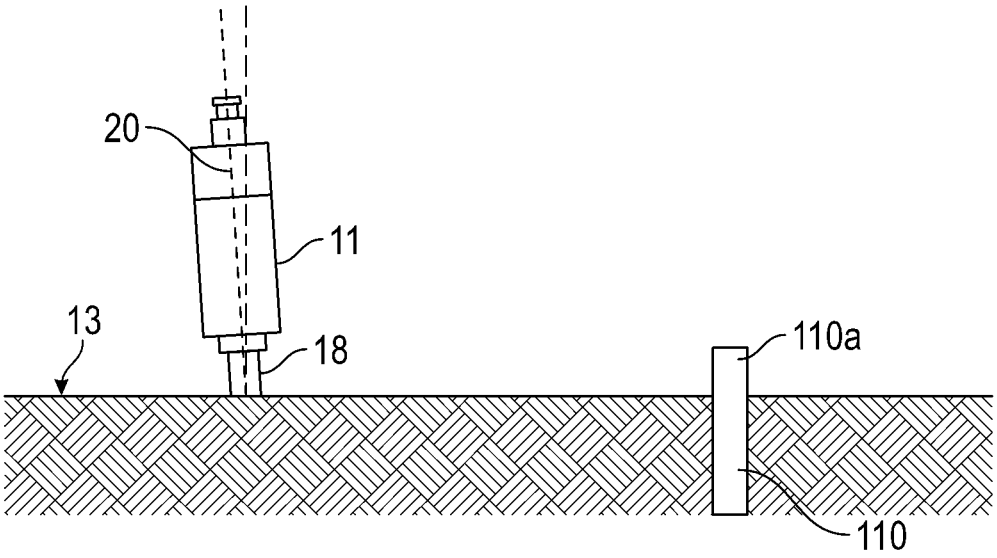
Figure 18C:
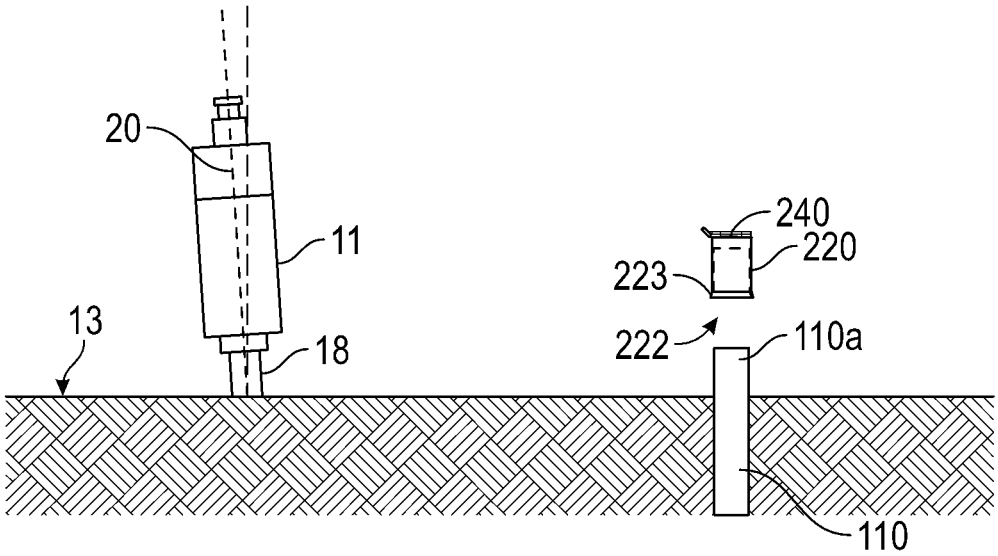
Figure 18D:
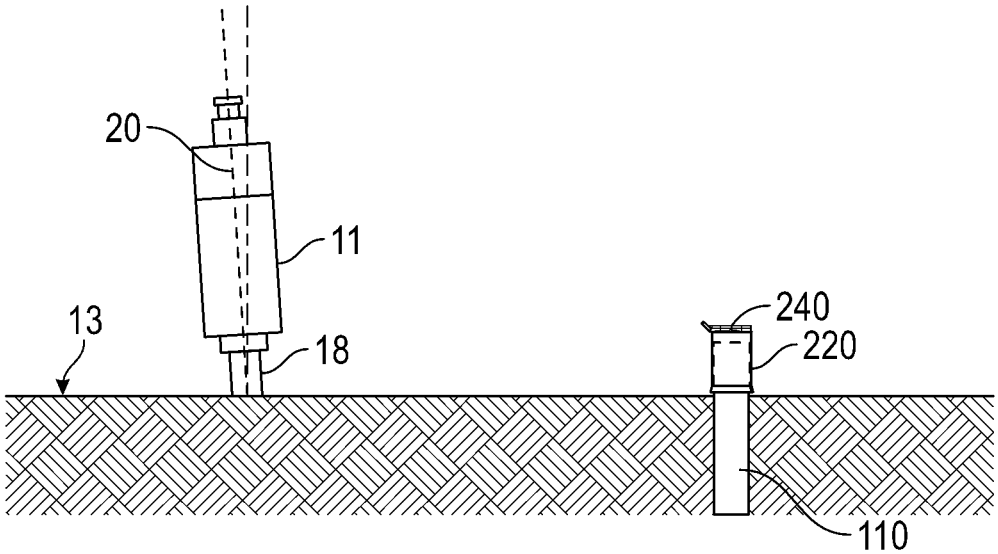

Referring now to FIGS. 18A-18D, in this embodiment, system 200 is deployed and installed in stages. System 200 is preferably installed subsea at a location that is diametrically opposed (i.e., 180° from) the direction to which wellhead 12, BOP 11, and LMRP 14 are leaning. First, anchor 110 is lowered subsea and inserted (e.g., driven) into the sea floor 13 in a vertical orientation as shown in FIGS. 18A and 18B. Upper end 110*a* of anchor 110 remains positioned above the sea floor 13. Next, as shown in FIGS. 18C and 18D, adapter 220, with interface assembly 240 attached thereto and gripping members 128 radially withdrawn with actuators 127, is lowered subsea and mounted to upper end 110*a*. Receptacle 222 is generally coaxially aligned with anchor 110 as adapter 220 is lowered onto upper end 110*a*. Funnel 223 aids in guiding adapter 220 to coaxial alignment with anchor 110 as it is lowered onto upper end 110*a*. With end 110*a* sufficiently seated in receptacle 222, adapter 220 is locked onto anchor 110 with rams 126.

Figure 18E:
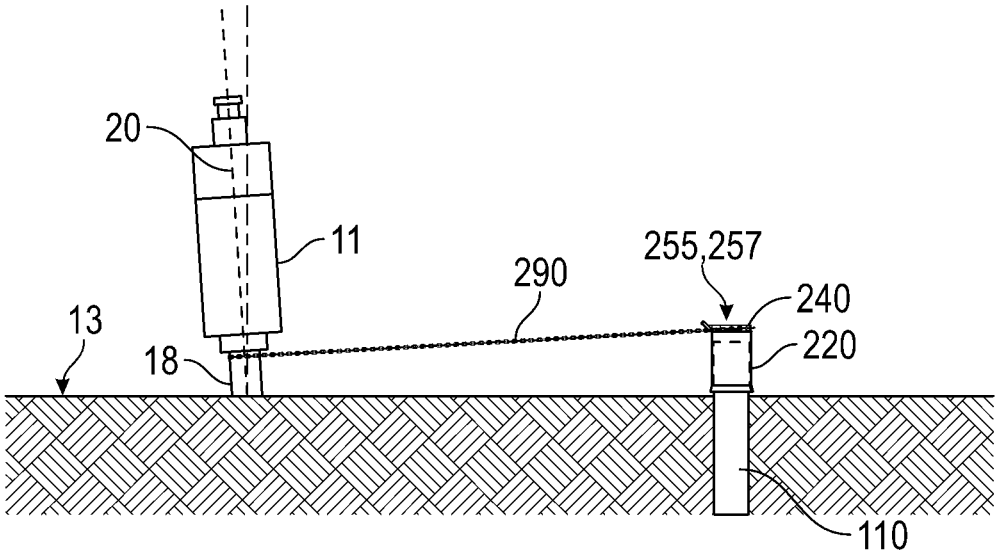

Next, as shown in FIG. 18E, tension member 290 is coupled to conductor 18 and interface assembly 240 via grab 255. In particular, chain 290 is positioned in recess 248 between chain guide 244 with claws 257 positively engaging one link of chain 290. The end of chain 290 extending from funnel 249 is coupled to the upper end of primary conductor 18 and the opposite end of chain 290 hangs freely from the opposite end of interface assembly 240. In this embodiment, tension assembly 260 can be operated through multiple cycles along interface assembly 240 to pull member 290 taut and to apply varying degrees of tension to member 290. Thus, tension member 290 can be secured to claws 257 with slack in member 290 or with member 290 taut between claws 257 and conductor 18.

Figure 18F:
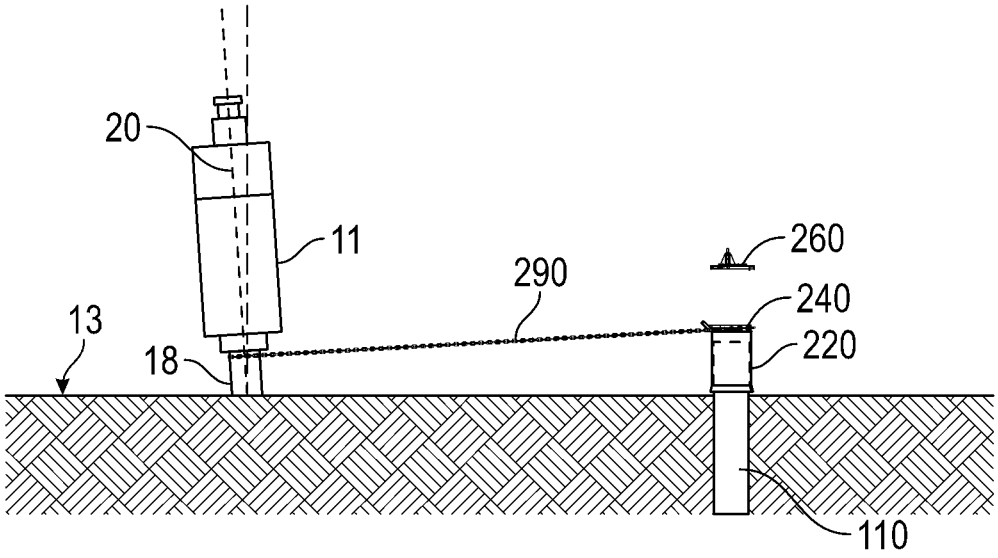
Figure 18G:
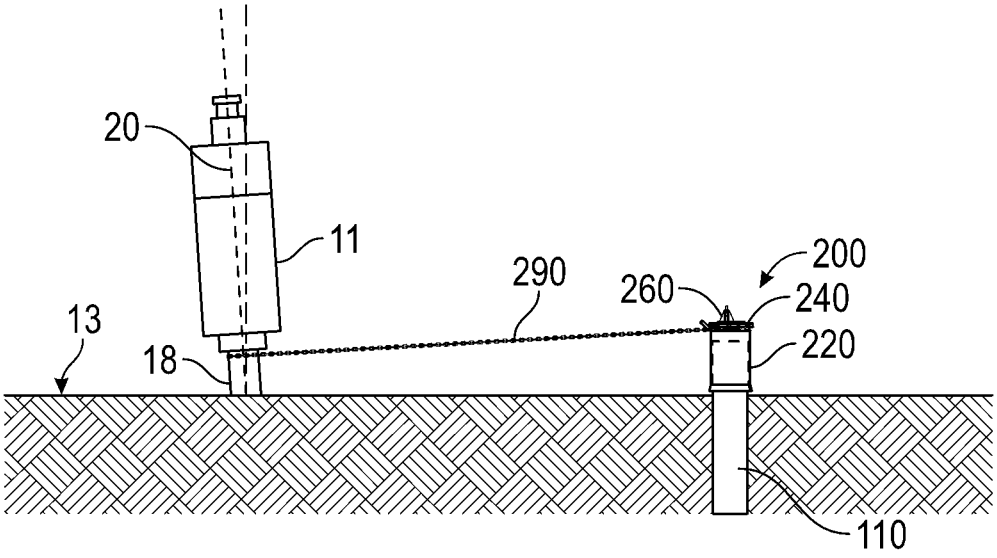

Moving now to FIGS. 18F and 18G, tension assembly 260 is lowered subsea and coupled to interface assembly 240. In particular, base 261 is seated in receptacle 251 with shoulders 263 engaging ends 244*a*. Chain grab 278 is preferably withdrawn upward in cavity 267 with actuator 274 so as not to interfere with chain 290 during installation. In addition, actuator 280 is preferably retracted such that grab 278 will not interfere with grab 255 when it is lowered into recess 248 to grasp chain 290 as described in more detail below. A subsea ROV can be employed to provide hydraulic pressure to actuators 274, 280 for subsea operation.

Figure 18H:
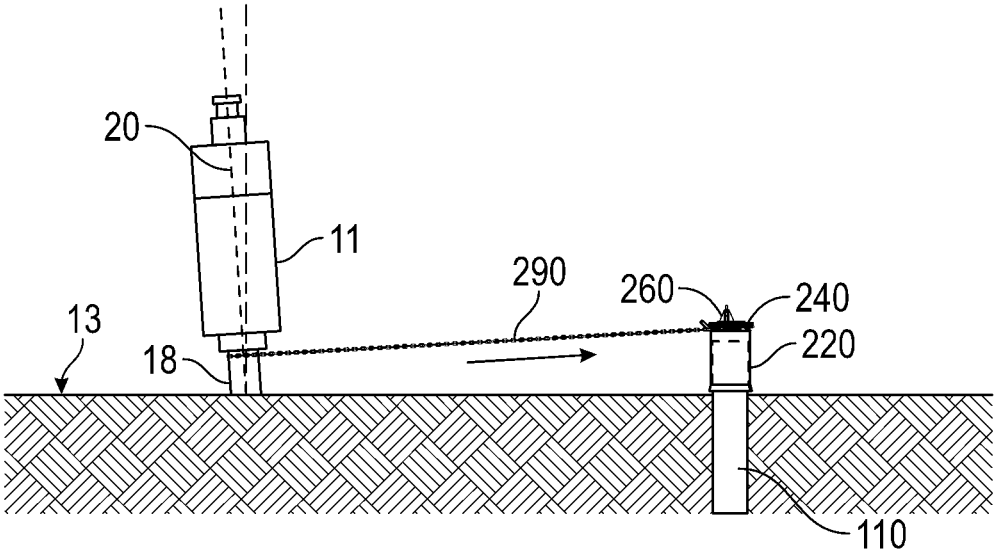
FIGS. 18H and 18I are sequential schematic side views of the system of FIG. 7 being used to straighten the bent well of FIG. 2.
Figure 18I:
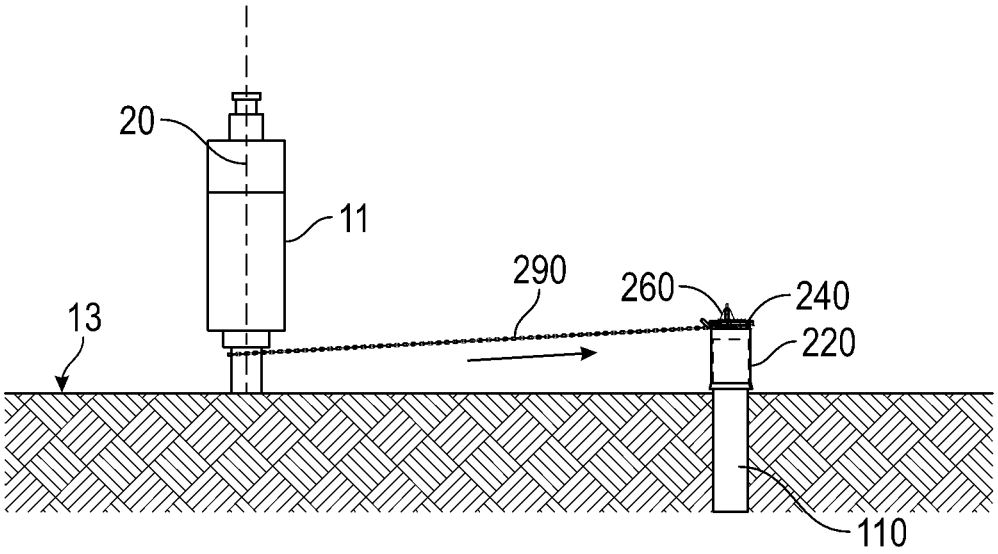

Referring now to FIGS. 18H and 18I, to straighten conductor 18, grab 278 is lowered into recess 248 with actuator 274, and then actuator 280 is extended to enable grab 278 to positively engage and grasp one link of chain 290. This effectively transfers the tension in chain 290 from grab 255 to grab 278. With tension member 290 taut between conductor 18 and grab 278, actuator 274 is contracted to raise grab 278 and chain 290 from grab 255 within recess 248, and then actuator 280 is extended, thereby moving traveling assembly 270 along base 261. The movement of traveling assembly 270, and hence grab 278, applies tensile loads on chain 290 and a lateral load to primary conductor 18. Chain 290 is pulled through recess 248 with grab 278 just above grab 255. The tension in chain 290 and corresponding lateral load applied to primary conductor 18 are increased until conductor 18 is slowly bent back to vertical (within a desired tolerance) as shown in FIG. 18I. An inclinometer is preferably attached to conductor 18, BOP 11, or LMRP 14 to indicate when the vertical orientation (within the desired tolerance) is achieved.

In general, conductor 18 can be bent to vertical without plastically deforming conductor 18, and then held in the vertical orientation by lowering grab 278 and chain 290 with actuator 274, and then slightly retracting actuator 280 to allow grab 255 to positively engage and grasp chain 290, thereby transferring the tensile loads from grab 278 to grab 255. Once grab 255 is supporting the tensile loads in chain 290, tension assembly 260 can be retrieved to the surface. Alternatively, conductor 18 can be bent sufficiently beyond vertical and plastically deformed such that conductor 18 will rebound to the vertical orientation upon release of the lateral loads applied by chain 290. Once conductor 18 is stable in the vertical orientation after plastic deformation, tension assembly 260 and adapter 220 (with interface assembly 240 mounted thereto) can be retrieved to the surface.

Figure 19:
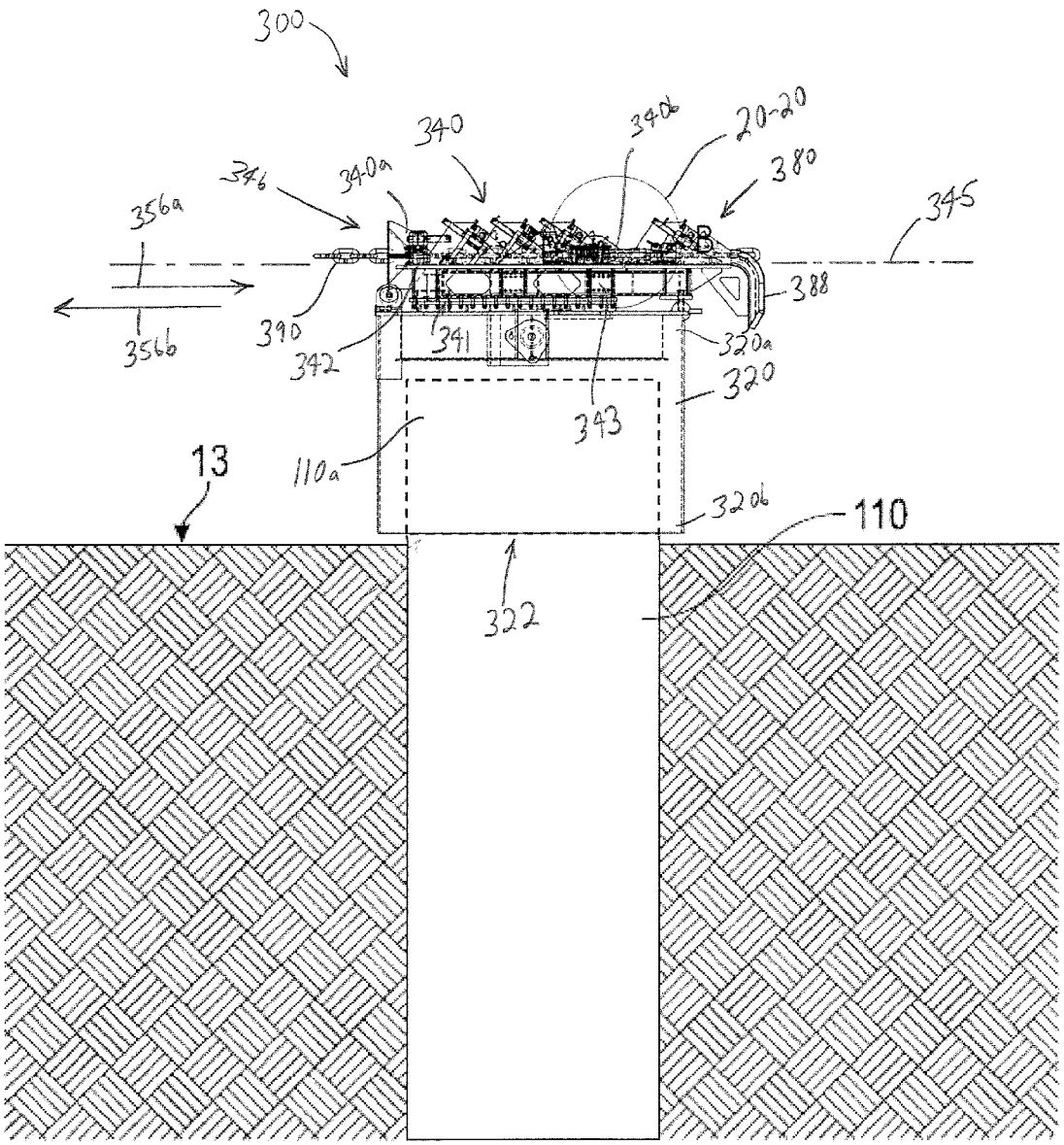
FIG. 19 is a schematic side view of an embodiment of system in accordance with the principles described herein for straightening the bent subsea well of FIG. 2.

Referring now to FIG. 19, an embodiment of a system 300 for straightening conductor 18 and moving wellhead 12, BOP 11, and LMRP 14 from non-zero skew angle $\alpha$ to a vertical orientation aligned with axis 20 is shown. In this embodiment, system 300 includes an anchor 110 as previously described extending into and secured to the sea bed, an anchor adapter 320 releasably mounted to anchor 110, an adapter interface assembly 340 fixably coupled to adapter 320, and a tension assembly 380 moveably coupled to interface assembly 340. As will be described in more detail below, tension assembly 380 applies tensile loads to a flexible tension member 390, which exerts lateral loads on the upper end of conductor 18 to pull it to a vertical orientation. In this embodiment, tension member 390 is a chain, and thus, may also be referred to as chain 390.

Referring still to FIG. 19, adapter 320 is coaxially aligned with pile 110 and removably mounted to upper end 110*a*. Adapter 320 is substantially the same as adapters 120, 220 previously described. In particular, adapter 320 is a generally cylindrical inverted bucket having a first or upper end 320*a* and a second or lower end 320*b*. Upper end 320*a* is closed, whereas lower end 320*b* is open. In particular, a lower receptacle 322 extends axially from open lower end 320*b*. Lower receptacle 322 is sized and configured to receive upper end 110*a*. Although not shown in FIG. 19, adapter 320 is preferably provided with a plurality of circumferentially-spaced rams 126 as previously described, which can be actuated to engage and disengage upper end 110*a* of pile 110 disposed in receptacle 322 to releasably lock adapter 320 to pile 110 once upper end 110*a* sufficiently seated in receptacle 322. In embodiments of adapter 320 employing rams 126, preferably four uniformly circumferentially-spaced rams 126 are provided. To facilitate the coaxial alignment of adapter 320 and anchor 110, and the receipt of upper end 110*a* into receptacle 322, an annular funnel (e.g., funnel 223) can optionally be disposed at lower end 320*b*. In this embodiment, adapter 320 is a subsea pile top adapter (PTA) made by Oil States Industries of Arlington, Tex.

Referring now to FIGS. 19-24, interface assembly 340 has a longitudinal axis 345, a first end 340*a* at which tension member 390 enters assembly 340, and a second end 340*b* at which tension member 390 exits assembly 340. In this embodiment, interface assembly 340 includes a horizontal rectangular base plate 341, a horizontal rectangular support plate 342 vertically spaced above base plate 341, and a plurality of vertical support posts 343 extending between plates 341, 342. Base plate 341 is secured to upper end 320*a* of adapter 320, thereby attaching interface assembly 340 thereto. Base plate 341, and hence interface assembly 340, is preferably removably secured to adapter 320. In this embodiment, base plate 341 is bolted to upper end 320*a* of adapter 320. Since base plate 341 is removably secured to adapter 320, and adapter 320 is removably secured to anchor 110, adapter 320 and interface assembly 340 can be reused with different anchors (e.g., at different subsea locations). In other embodiments, the base plate (e.g., base plate 341), and hence the interface assembly (e.g., interface assembly 340) is fixably secured to the adapter (e.g., adapter 320) such as via welding.

Support posts 343 are axially and laterally spaced relative to axis 345 in top view. In this embodiment, three posts 343 are axially spaced along one side of axis 345 in top view and three posts 343 are axially spaced along the other side of axis 345 in top view. Plates 341, 342 and support posts 343 define an elongate receptacle or cavity 344 that extends axially through assembly 340. In other words, cavity 344 is positioned vertically between plates 341, 341 and laterally between posts 343.

Figure 22:
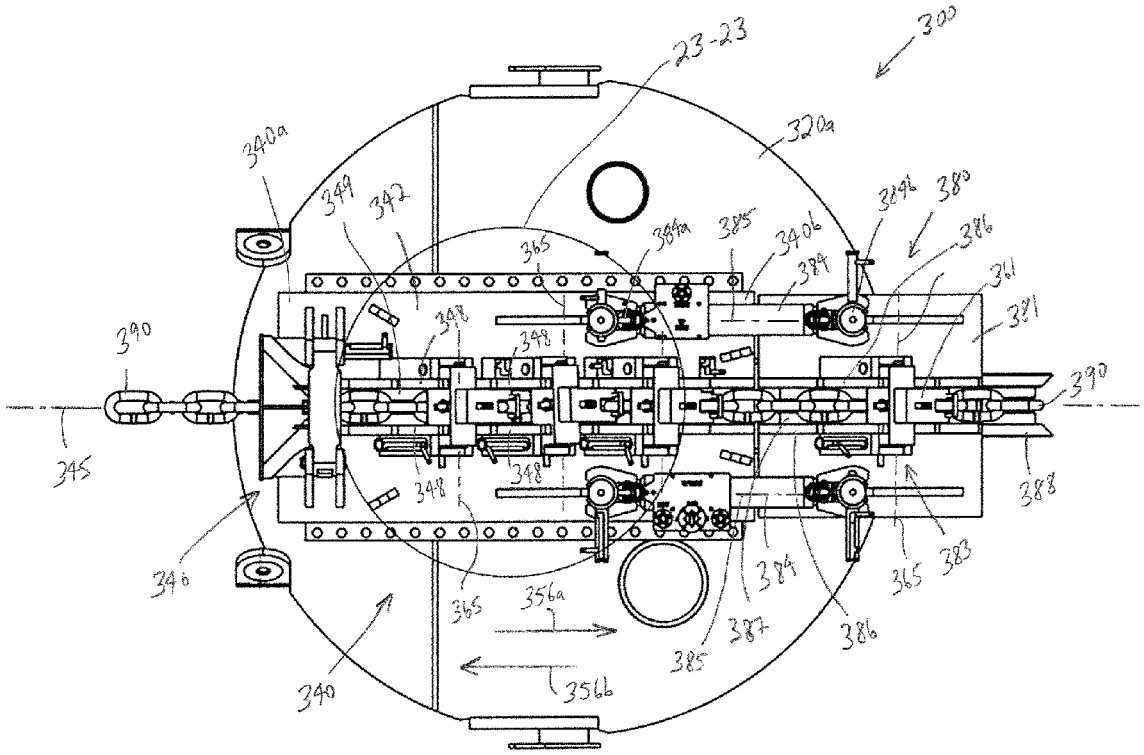
FIG. 22 is a top view of the system of FIG. 19.
Figure 23:
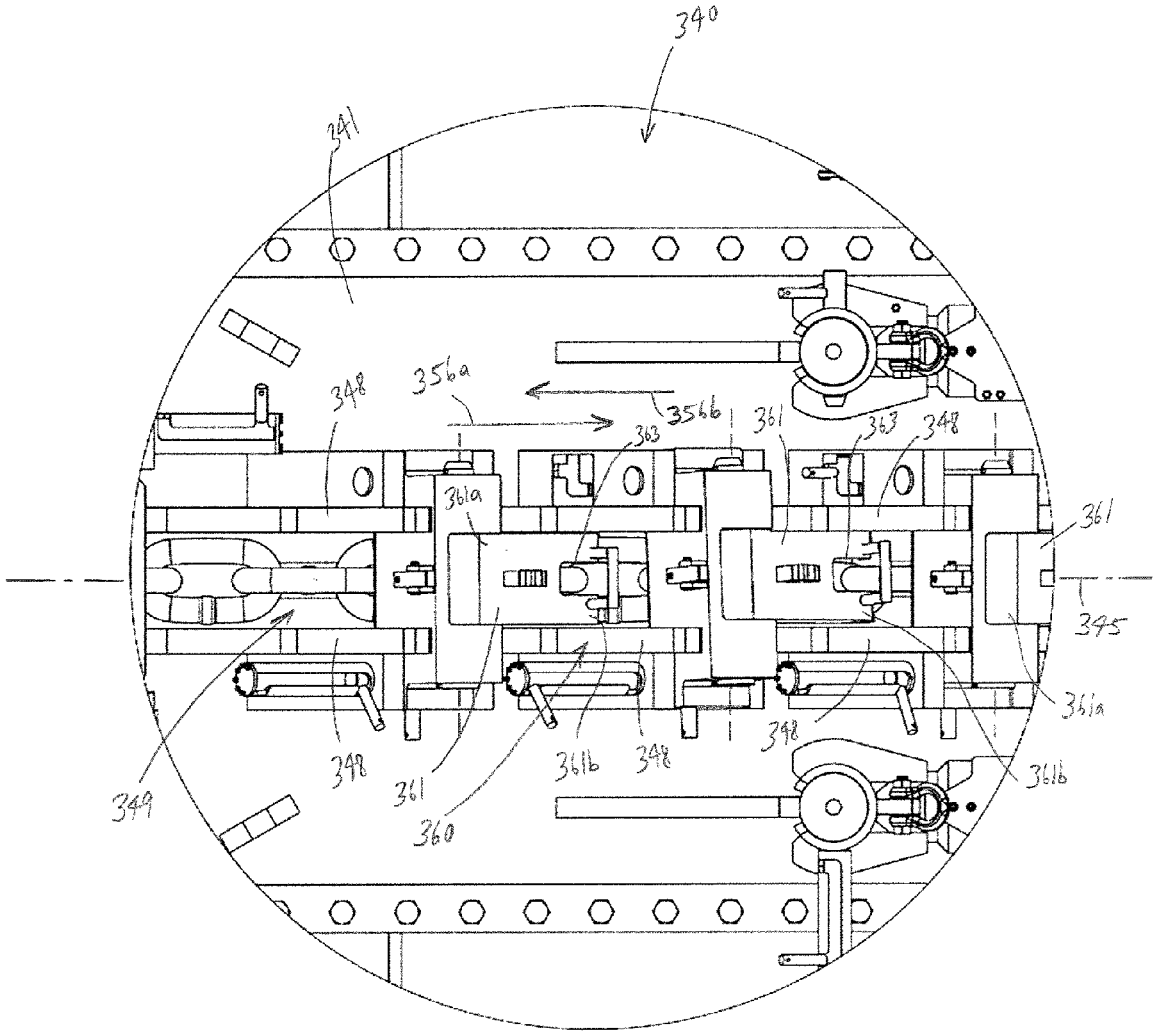
FIG. 23 is an enlarged view of section 22-22 of FIG. 22.
Figure 24:
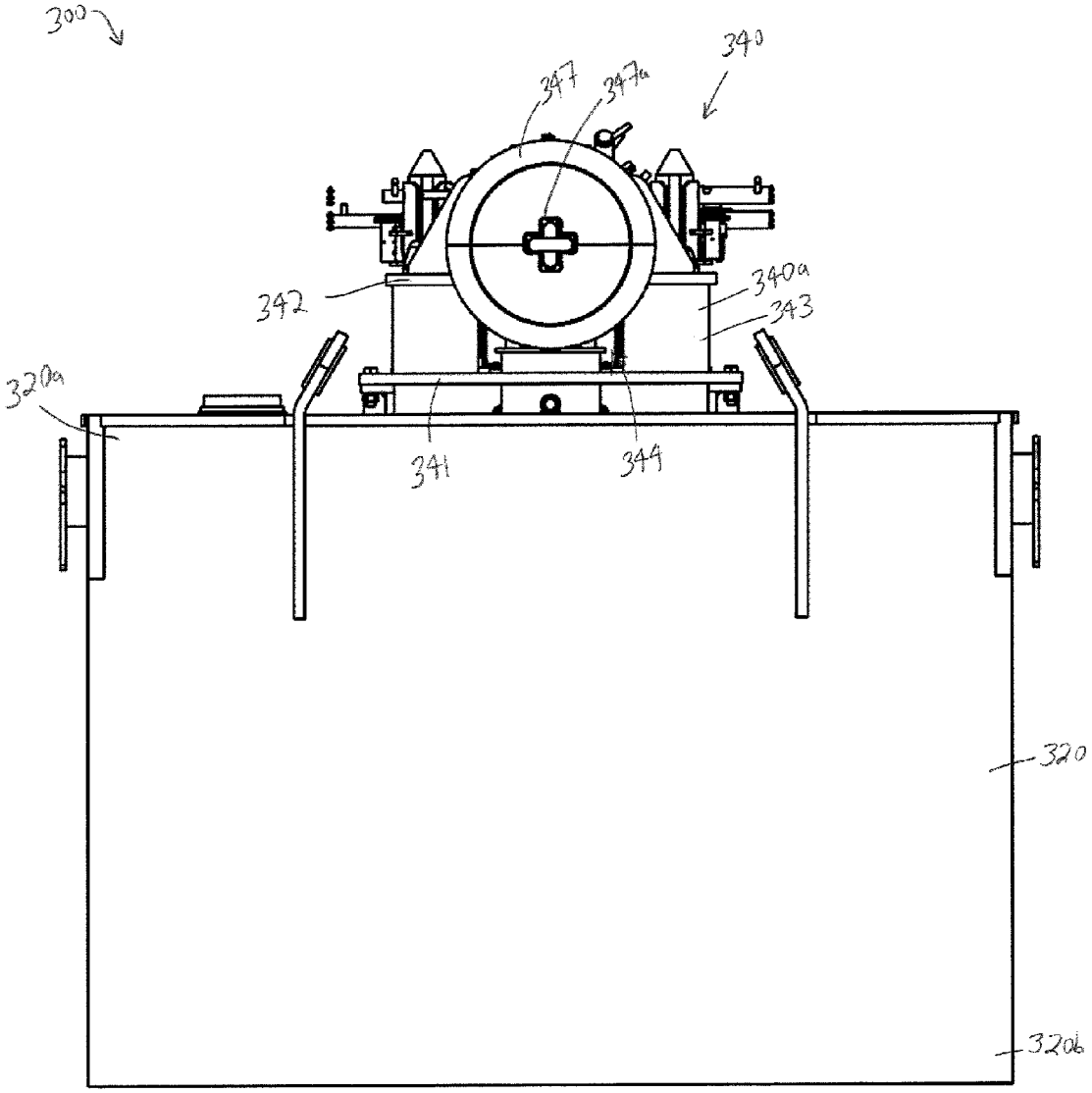
FIG. 24 is a front view of the system of FIG. 19.

A guide assembly 346 is provided along the top of support plate 342. In this embodiment, guide assembly 346 includes a funnel 347 mounted to support plate 342 at end 340*a* and a plurality of axially and laterally spaced vertical guide members or plates 348 mounted to support plate 342 between ends 340*a*, 340*b*. Funnel 347 includes a cross-shaped aperture 347*a* sized and configured to allow chain 390 to pass therethrough. Guide plates 348 are arranged in pairs, each pair including one guide plate 348 laterally opposed to another guide plate 348 in top view. Guide plates 348 in each pair of guide plates 348 are laterally spaced the same distance from axis 345 in top view. Support plate 342 and guide plates 348 define an elongate linear recess or channel 349 that extends axially from aperture 347*a* to end 340*b*. Channel 349 extends along a central or longitudinal axis oriented parallel to axis 345. Funnel 347 guides tension member 390 into channel 349. As best shown in FIGS. 22 and 23, during straightening operations, chain 390 is pulled axially (relative to axis 345) through funnel 347, aperture 347*a*, and channel 349 by tension assembly 380.

Referring now to FIGS. 21-23 and 25, in this embodiment, interface assembly 340 includes a locking assembly 360 disposed in channel 349 between each pair of laterally opposed vertical guide plates 348. In general, locking assembly 360 allows chain 390 to move through channel 349 in a first axial direction 356*a* (to the right in FIGS. 19, 22, 23, and 25), but positively engages and grasps tension member 390 when it seeks to move in a second direction 356*b* opposite axial direction 356*a* (to the left in FIGS. 19, 22, 23, and 25).

Figure 25:
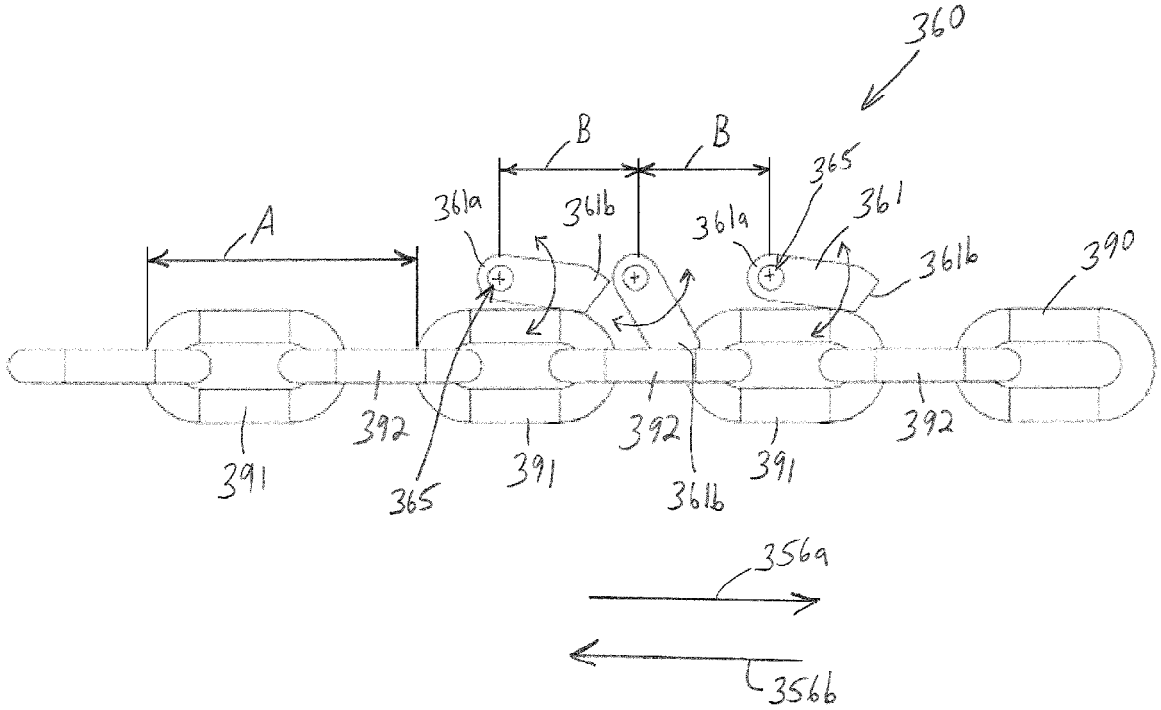
FIG. 25 is a schematic side view of the locking assembly of the system of FIG. 19 with the tension member extending therethrough.

As best shown in FIGS. 23 and 25, in this embodiment, locking assembly 360 comprises a plurality of axially spaced (relative to axis 345) locking members or chucks 361 configured to rotate into and out of locking engagement with chain 390 as chain 390 is pulled therebetween. More specifically, each chuck 361 is positioned between a pair of laterally opposed guide plates 348 and includes a first or upper end 361*a* pivotally coupled to the corresponding pair of laterally opposed guide plates 348 and a second or lower end 361*b* that slidingly engages chain 390. Upper end 361*a* of each chuck 361 is vertically spaced above chain 390. In this embodiment, chucks 361 are oriented and pivotally coupled to guide plates 348 such that each chuck 361 pivots about a horizontal axis 365 that is oriented perpendicular to axis 345 in top view.

Referring now to FIG. 25, chain 390 includes a plurality of vertically oriented links 391 and a plurality of horizontally oriented links 392 arranged in an alternating fashion. Each chuck 361 has an unlocked or open position with end 361*b* slidingly engaging the top of a vertically oriented link 391 and pivoted away from the adjacent horizontally oriented links 391, and a locked or closed position with end 361*b* pivoted into sliding engagement with the top of a horizontally oriented link 392. In this embodiment, ends 361*b* are biased by gravity into engagement with the top of chain 390, and thus, each chuck 361 is generally biased toward the locked position. Although each chuck 361 is biased to the locked position, as chain 390 is pulled through locking assembly 360 in first direction 356*a*, the vertically oriented links 391 urge or cam ends 361*b* outward and away from the horizontally oriented links 391, thereby allowing chain 390 to be pulled therethrough. However, since each chuck 361 is biased to the locked position, movement of chain 390 in the second direction 356*b* is generally prevented once at least one chuck 361 transitions to the locked position with end 361*b* simultaneously engaging a horizontally oriented link 392 and axially abutting the left end of the adjacent vertically oriented link 391 as any continued movement in the second direction 356*b* causes that chuck 361 to wedge against the horizontal oriented link 392 and block the adjacent vertically oriented link 391. As best shown in FIG. 23, in this embodiment, end 361*b* of each chuck 361 includes a recess 363 sized to receive the end of a vertically oriented link 391 when the corresponding locking assembly 360 is in the locked position. Although chucks 361 are biased toward the locked position via gravity in this embodiment, in other embodiments, the chucks (e.g., chucks 361) can be biased by other suitable means known in the art such as springs, or actuated between the unlocked and locked positions by an actuator (e.g., hydraulic motor, electric motor, etc.).

As best shown in FIG. 25, chain 390 is prevented from moving in the second axial direction 356*b* (to the left in FIG. 25) when one chuck 361 is in the locked position with end 361*b* simultaneously engaging a horizontally oriented link 392 and axially abutting the left end of the adjacent vertically oriented link 391. It should be appreciated that if only one chuck 361 is provided (as opposed to multiple chucks 361), a distance A between the left ends of each pair of adjacent vertically oriented links 391 represents the minimum distance that chain 390 must move in first direction 356*b* before the chuck 361 can transition to the locked position with end 361*b* simultaneously engaging a horizontally oriented link 392 and axially abutting the left end of the adjacent vertically oriented link 391. However, in this embodiment, multiple chucks 361 axially spaced apart a distance B (measured between pivot axes 365) that is less than distance A are provided. This enables a smaller minimum distance that chain 390 must be moved in first direction 356*a* before at least one chuck 361 can transition to the locked position with end 361*b* simultaneously engaging a horizontally oriented link 392 and axially abutting the left end of the adjacent vertically oriented link 391. In general, a reduction in the minimum distance between the locked positions enables finer control over the position of chain 390 and more precise positioning and locking of conductor 18 at the desired orientation. In this embodiment, distance B is one-half distance A. Thus, when one chuck 361 is in the locked position engaging a horizontally oriented link 392 and the left end of the adjacent vertically oriented link 391, the other chucks 361 of the interface assembly 340 are in open positions.

Figure 20:
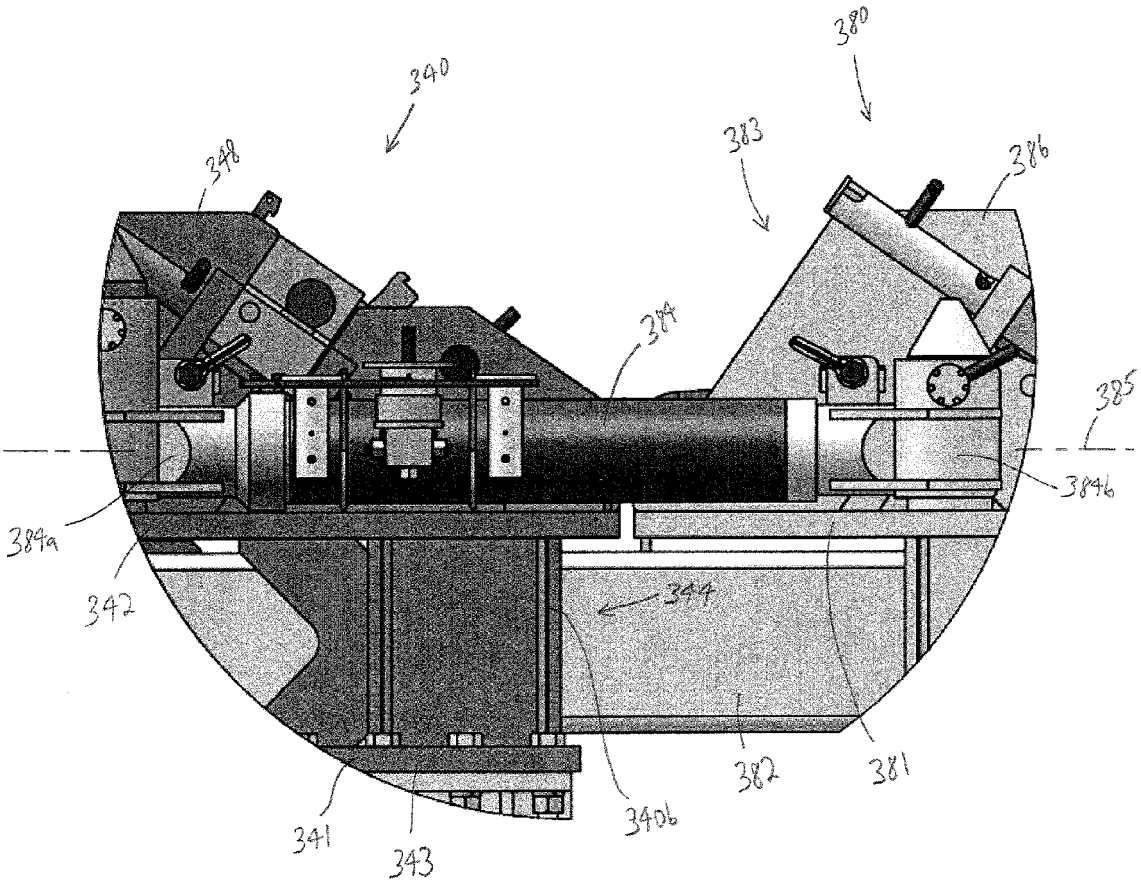
FIG. 20 is an enlarged view of section 20-20 of FIG. 19.
Figure 21:
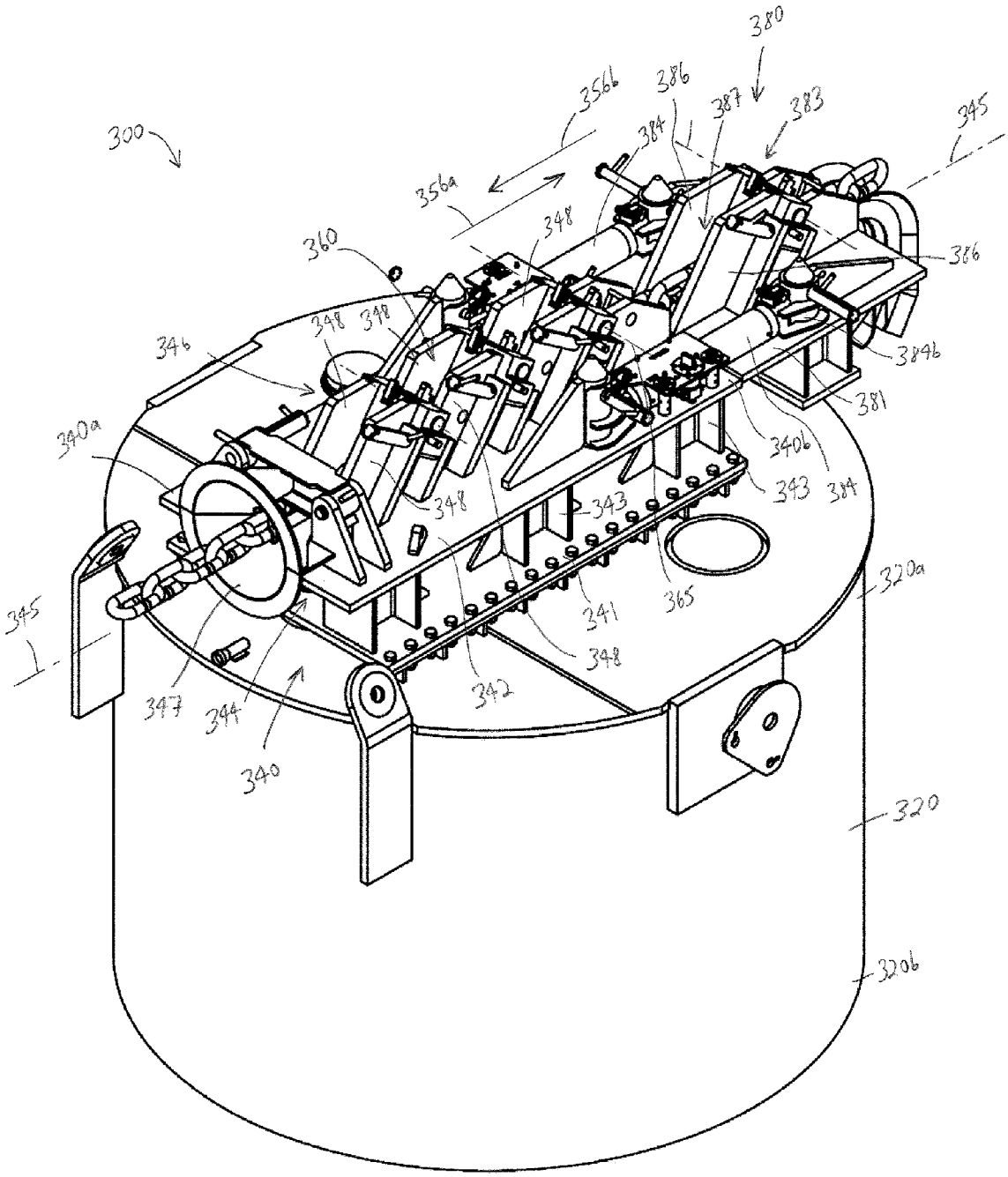
FIG. 21 is an isometric view of the system of FIG. 19.

Referring now to FIGS. 20-22, tension assembly 380 is configured to move axially relative to interface assembly 340 and adapter 320, and further, applies tensile loads to chain 390. In this embodiment, tension assembly 380 includes a support plate 381, an elongate guide member 382 coupled to support plate 381, a guide assembly 383 mounted to support plate 381, and a pair of linear actuators 384. Support plate 381 is positioned axially adjacent end 340*b* of interface assembly 340 (relative to axis 345) and is vertically aligned with support plate 342. Guide member 382 is attached to the bottom of support plate 381 and extends into cavity 344. In particular, guide member 382 slidingly engages support posts 343 and base plate 341, which generally restrict guide member 382 to axial movement relative to interface assembly 340.

Guide assembly 383 is provided along the top of support plate 381 and is generally axially aligned (relative to axis 345) with guide assembly 346 of interface assembly 340. In this embodiment, guide assembly 383 includes a pair of laterally spaced vertical guide members or plates 386 mounted to support plate 381. Guide plates 386 are laterally opposed to each other in top view. In this embodiment, guide plates 386 are laterally spaced the same distance from axis 345 in top view. Support plate 381 and guide plates 386 define an elongate recess or channel 387 that extends axially (relative to axis 345) along the top of support plate 381. Channel 387 is coaxially aligned with channel 349 of interface assembly 340. As best shown in FIGS. 22 and 23, during straightening operations, chain 390 moves axially (relative to axis 345) through channel 387. A gooseneck 388 is mounted on the end of support plate 381 and generally extends from channel 387. Gooseneck 388 guides chain 390 as it is pulled through assemblies 340, 380 and hangs off the end of plate 381.

Referring still to FIGS. 20-22, linear actuators 384 extend between support plates 342, 381 and are configured to move tension assembly 380, and more particularly support plate 381, axially back and forth relative to interface assembly 340 and adapter 320. Each linear actuator 384 has a central or longitudinal axis 385, a first end 384*a* coupled to plate 342, and a second end 384*b* coupled to plate 381. In addition, each linear actuator 384 is configured to axially extend and retract, thereby moving ends 384*a*, 384*b* axially towards and away from each other. In this embodiment, each actuator 384 is a double-acting hydraulic piston-cylinder assembly. Axes 385 are oriented parallel to axis 345, are disposed on opposite sides of axis 345 in top view, and lie in a common horizontal plane. Thus, as linear actuators 384 extend, support plate 381 moves axially away from interface assembly 340, and as linear actuators 384 retract, support plate 381 moves axially toward interface assembly 340.

As best shown in FIG. 22, tension assembly 380 also includes a locking member or chuck 361 as previously described. In particular, chuck 361 of tension assembly 380 is disposed in channel 387 between vertical guide plates 386. In the same manner as previously described, chuck 361 of tension member 380 allows chain 390 to move through channel 387 in a first axial direction 356*a* (to the right in FIGS. 19, 22, 23, and 25), but positively engages and grasps tension member 390 when it seeks to move in a second direction 356*b* opposite axial direction 356*a* (to the left in FIGS. 19, 22, 23, and 25).

Referring now to FIGS. 19, 21, and 22, to apply tension to chain 390, chuck 361 of tension assembly 380 is transitioned to the locked position. This can be done by pulling chain 390 through channels 349, 387 until end 361*b* of chuck 361 moves into engagement with a horizontally oriented link 392 or by moving support plate 381 axially relative to chain 390 with actuators 384 until end 361*b* of chuck moves into engagement with a horizontally oriented link 392. A sufficient length of chain 390 preferably hangs from plate 381 over gooseneck 388 as support plate 381 is moved axially in the second direction 356*b* toward interface assembly 340 to ensure there is sufficient tension on the portion of chain 390 extending through channel 387 to prevent chain 390 from buckling. With chuck 361 of tension assembly 380 in the locked position, actuators 384 are extended, thereby moving support plate 381 axially (relative to axis 345) away from interface assembly 340 and pulling chain 390 with it in first direction 356*a* through channel 349. Once actuators 384 reach the end of their stroke (i.e., actuators 384 are fully extended), actuators 384 are retracted to move support plate 381 axially towards interface assembly 340. As support plate 381 is moved toward interface assembly 340, chuck 361 of tension assembly 380 transitions to the open position and no longer prevents chain 390 from moving in the second direction 356*b*. However, chucks 361 of interface assembly 340 prevent chain 390 from moving in the second direction 356*b*. Actuators 384 move support plate 381 to support plate 342, and the process is repeated. In this iterative manner, tension assembly 380 applies tension to chain 390 and pulls chain 390 through channels 349, 387.

To straighten primary conductor 18 and move wellhead 12, BOP 11, and LMRP 14 back to the vertical orientation, system 300 is deployed and installed subsea, and then employed to apply a lateral load to the upper end of primary conductor 18 proximal wellhead 12 with tension member 390. In FIGS. 26A-26E, system 300 is shown being deployed and installed subsea, and in FIGS. 26F and 26G, system 300 is shown being used to apply a lateral load to the upper end of primary conductor 18 proximal wellhead 12 with tension member 390.

Figure 26A:
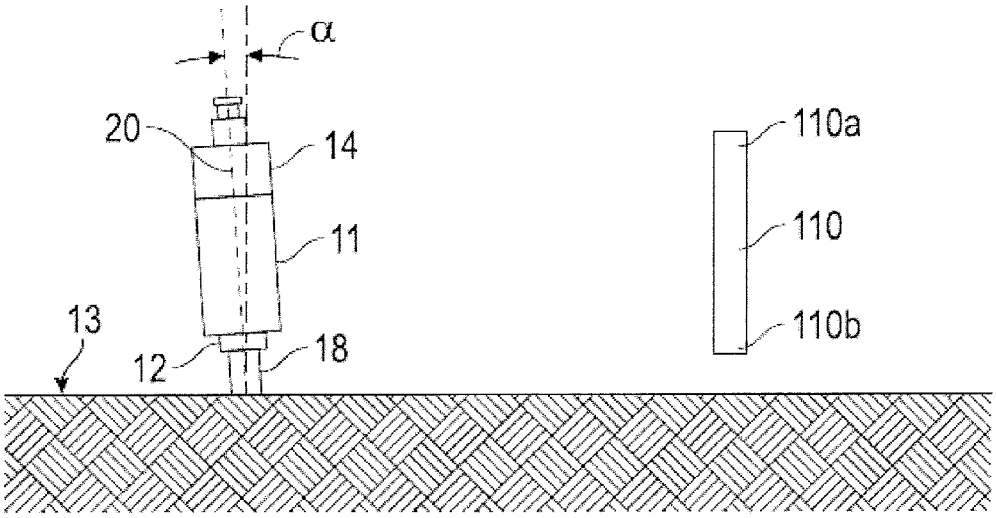
FIGS. 26A-26E are sequential schematic side views of the system of FIG. 19 being deployed and installed subsea.
Figure 26B:
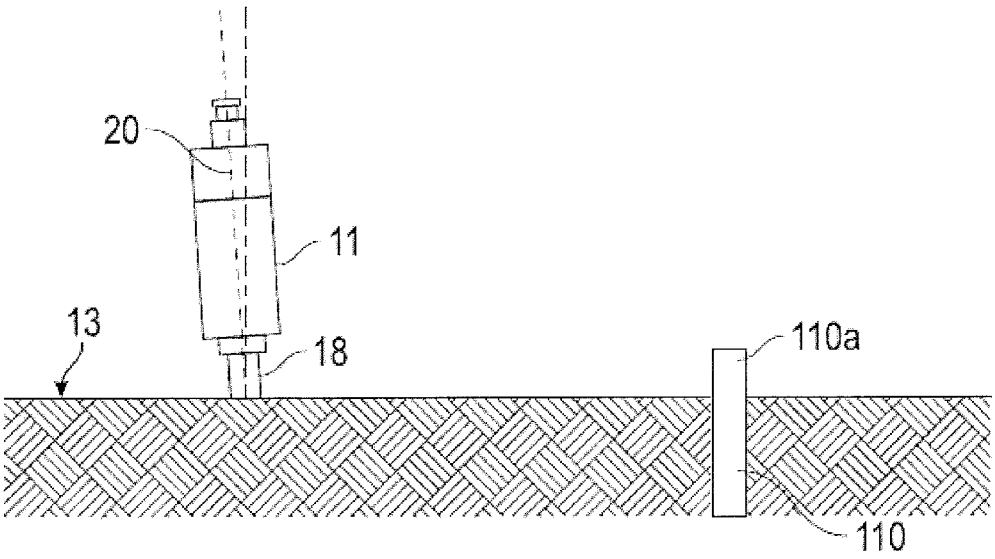
Figure 26C:
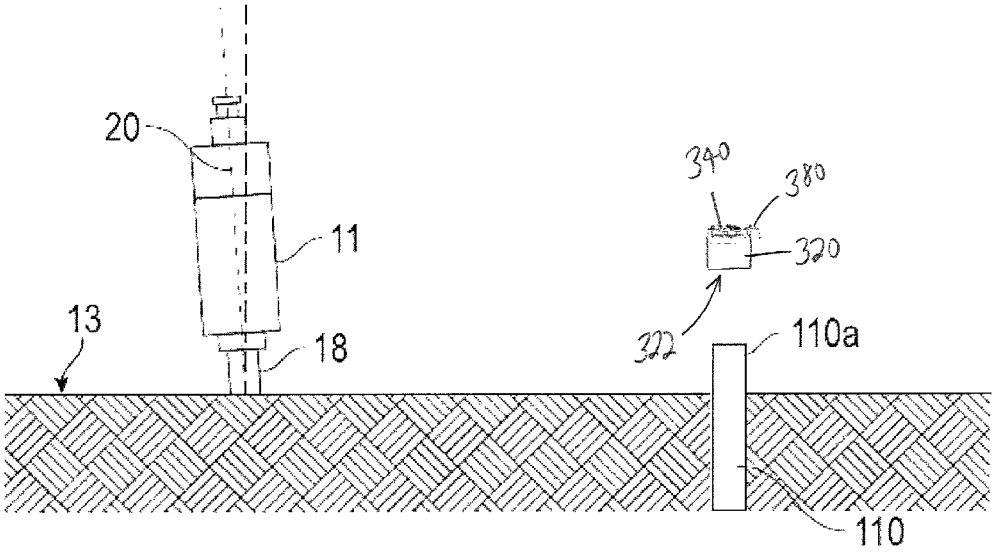
Figure 26D:
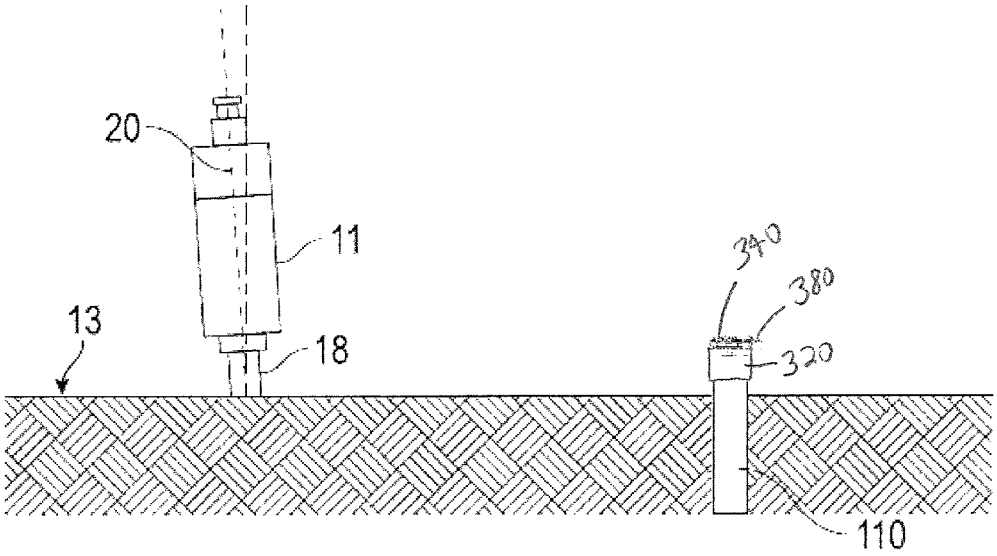

Referring now to FIGS. 26A-26D, in this embodiment, system 300 is deployed and installed in stages. System 300 is preferably installed subsea at a location that is diametrically opposed (i.e., 180° from) the direction to which wellhead 12, BOP 11, and LMRP 14 are leaning. First, anchor 110 is lowered subsea and inserted (e.g., driven) into the sea floor 13 in a vertical orientation as shown in FIGS. 26A and 26B. Upper end 110*a* of anchor 110 remains positioned above the sea floor 13. Next, as shown in FIGS. 26C and 26D, adapter 320, with interface assembly 340 and tension assembly 380 coupled thereto, is lowered subsea and mounted to upper end 110*a*. Receptacle 322 is generally coaxially aligned with anchor 110 as adapter 320 is lowered onto upper end 110*a*. With end 110*a* sufficiently seated in receptacle 322, adapter 320 is locked onto anchor 110 with rams 126.

Figure 26E:
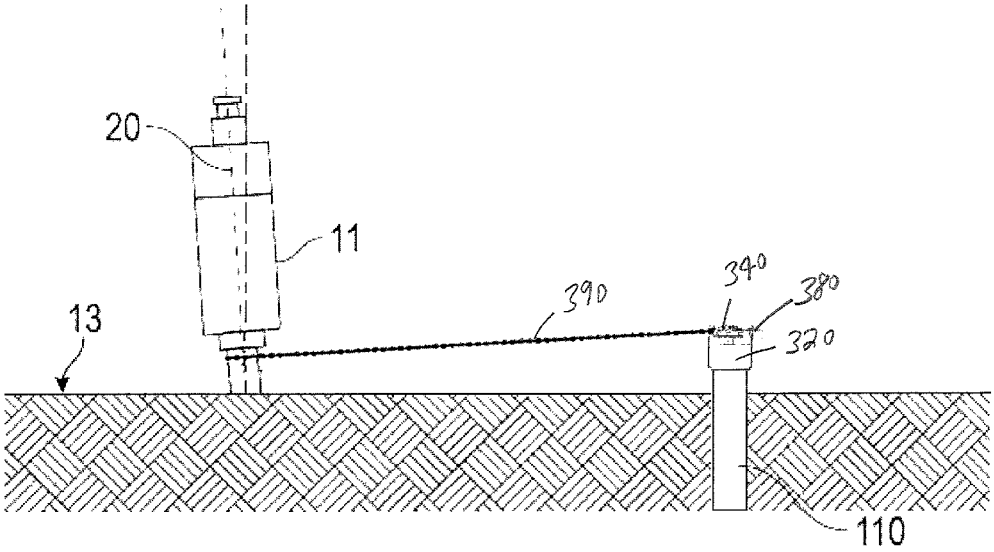

Next, as shown in FIG. 26E, tension member 390 is coupled to conductor 18 and pulled through funnel 347, channels 349, 387 (under chucks 361), and over gooseneck 388 (e.g., via a subsea ROV). Tension assembly 380 can then be operated through multiple cycles to pull member 390 taut and to apply varying degrees of tension to member 390.

Figure 26F:
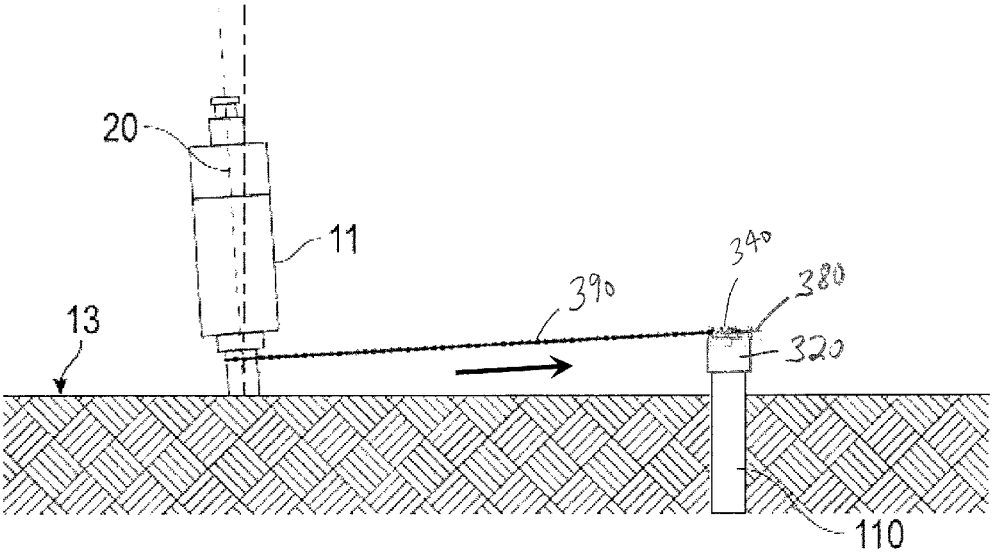
FIGS. 26F-26G are sequential schematic side views of the system of FIG. 19 being used to straighten the bent well of FIG. 2.
Figure 26G:
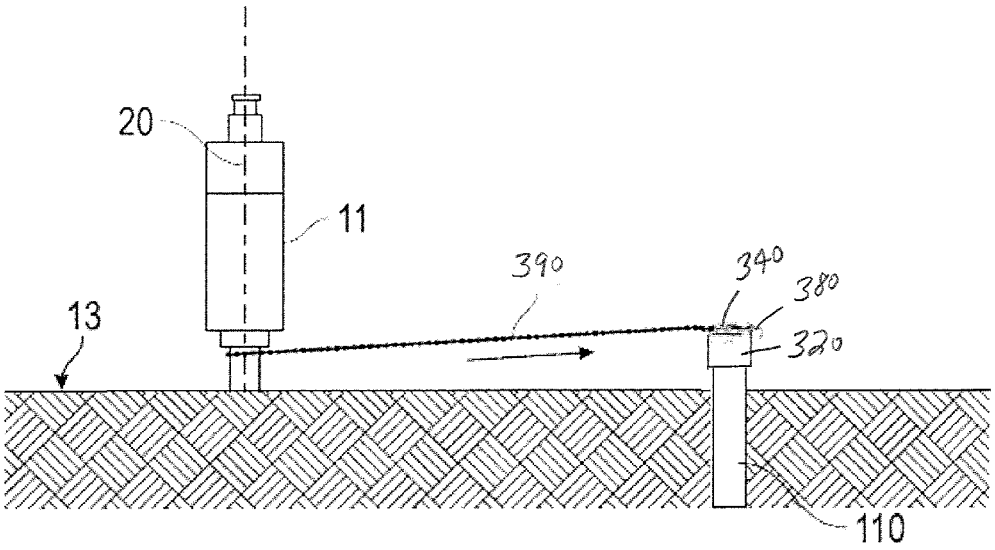

Moving now to FIGS. 26F and 26G, to straighten conductor 18, tension is applied to tension member 390 by pulling tension member 390 with tension assembly 380 as previously described. During this process, any tension in the portion of chain 390 extending from conductor 18 is transferred back and forth between locking assembly 360 of interface assembly 340 and chuck 361 of tension assembly 380. The movement of support plate 381 away from interface assembly 340, and hence chuck 361 of tension assembly 380, applies tensile loads on chain 390 and a lateral load to primary conductor 18.

The tension in chain 390 and corresponding lateral load applied to primary conductor 18 are increased until conductor 18 is slowly bent back to vertical (within a desired tolerance) as shown in FIG. 26G. An inclinometer is preferably attached to conductor 18, BOP 11, or LMRP 14 to indicate when the vertical orientation (within the desired tolerance) is achieved.

In general, conductor 18 can be bent to vertical without plastically deforming conductor 18, and then held in the vertical orientation by locking assembly 360 and chain 390, thereby relieving the loads applied to tension assembly 380 and actuators 384. Alternatively, conductor 18 can be bent sufficiently beyond vertical and plastically deformed such that conductor 18 will rebound to the vertical orientation upon release of the lateral loads applied by chain 390. Once conductor 18 is stable in the vertical orientation after plastic deformation, adapter 320, interface assembly 340, and tension assembly 380 can be retrieved to the surface.

As described above, each system 100, 200, 300 is installed subsea at a location that is diametrically opposed (i.e., 180° from) the direction to which wellhead 12, BOP 11, and LMRP 14 are leaning. However, in other embodiments, more than one system 100, 200, 300 can be deployed and operate together to pull a subsea structure. In general, the use of multiple systems 100, 200, 300 allows enhanced lateral control over the pulling forces exerted on the subsea structure (e.g., conductor 18). For example, in one embodiment, two systems 100 are deployed and installed subsea about +/−135° from the direction to which wellhead 12, BOP 11, and LMRP 14 are leaning. Each system 100 is then coupled to conductor 18 with a tension member 170, and pulls conductor 18 to bend it back to vertical (within a defined tolerance).

In the manner described, embodiments of systems (e.g., systems 100, 200, 300) and methods described herein can be used to straighten a bent primary conductor. Such systems operate completely subsea (at the sea floor) and are not tied to a surface vessel, thereby eliminating undesirable loads applied to the conductor via movement of a surface vessel, enabling the application of carefully controlled loads to the conductor, and eliminating the risk of further damage to conductor in the event of a loss of the dynamic positioning capabilities of the surface vessel. Although systems 100, 200, 300 have been shown and described in connection with subsea wells, and in particular, primary conductor 18, it should be appreciated that systems 100, 200, 300 can be deployed and used to pull any subsea structure.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for pulling a subsea structure, the system comprising:

an adapter configured to be mounted to an upper end of a subsea pile;

an interface assembly fixably coupled to the adapter, wherein the interface assembly has a longitudinal axis and includes a first channel configured to receive a flexible tension member and a first chuck disposed in the first channel, wherein the first chuck is configured to pivot about a horizontal axis between an unlocked position slidinglv engaging the flexible tension member and allowing the flexible tension member to move through the first channel in a first axial direction and a locked position engaging the flexible tension member and preventing the tension member from moving through the first channel in a second axial direction that is opposite the first axial direction;

a tension assembly moveably coupled to the adapter axially adjacent the interface assembly, wherein the tension assembly includes a second channel configured to receive the flexible tension member and a second chuck disposed in the second channel, wherein the second chuck is configured to pivot about a horizontal axis between an unlocked position slidingly engaging the flexible tension member and allowing the flexible tension member to move through the second channel in the first axial direction and a locked position engaging the flexible tension member and preventing the tension member from moving through the second channel in the second axial direction;

a linear actuator configured to move the tension assembly axially relative to the interface assembly, wherein the linear actuator extends axially from the interface assembly to the tension assembly.

2. The system of claim 1, wherein the adapter has an open lower end, a closed upper end, a receptacle extending from the lower end and configured to receive the upper end of the pile.

3. The system of claim 1, wherein the interface assembly includes a first horizontal support plate and a first pair of laterally opposed guide members extending upward from the plate, wherein the first channel extends between the first pair of laterally opposed guide members, and wherein the first chuck is pivotally coupled to the first pair of laterally opposed guide members of the interface assembly;

wherein the tension assembly includes a second horizontal support plate and a second pair of laterally opposed guide members, wherein the second channel extends between the second pair of laterally opposed guide members of the tension assembly, and wherein the second chuck is pivotally coupled to the second pair of laterally opposed guide members of the tension assembly.

4. The system of claim 3, wherein the linear actuator has a first end coupled to the support plate of the interface assembly and a second end coupled to the support plate of the tension assembly.

5. The system of claim 1, wherein the interface assembly includes a plurality of chucks disposed in the first channel, wherein each chuck of the interface assembly is configured to pivot about a horizontal axis between an unlocked position allowing the flexible tension member to move through the first channel in a first axial direction and a locked position preventing the tension member from moving through the first channel in a second axial direction that is opposite the first axial direction.

6. The system of claim 5, wherein the plurality of chucks of the interface assembly are axially spaced apart such that when one of the plurality of chucks of the interface assembly is in the locked position, the other of the plurality of chucks of the interface assembly are in the unlocked positions.

7. The system of claim 1, wherein the tension member is a chain including a plurality of vertically oriented links and a plurality of horizontally oriented links coupled to the plurality of vertically oriented links, wherein one horizontally oriented link is disposed between each pair of adjacent vertically oriented links;

wherein an end of the first chuck is configured to axially abut an end of one vertically oriented link in the locked position; and wherein an end of the second chuck is configured to axially abut an end of one vertically oriented link in the locked position.

8. A method for straightening a bent subsea well, the method comprising:

(a) securing an anchor to the sea floor;

(b) lowering an adapter subsea and mounting the adapter to an upper end of the anchor, wherein an interface assembly is fixably coupled to the adapter and a tension assembly is moveably coupled to the adapter;

(c) coupling a flexible tension member to a primary conductor of the bent well;

(d) positioning the tension member in a first channel of the interface assembly and a second channel of the tension assembly, wherein the first channel and the second channel extend linearly along a longitudinal axis;

(e) preventing the tension member from moving in a first axial direction relative to the tension assembly after (d);

(f) moving the tension assembly axially relative to the interface assembly in a second axial direction that is opposite the first axial direction and pulling the tension member through the first channel in a second axial direction after (e); and (g) applying a tensile load to the tension member during (f), wherein (g) comprises:

(g1) applying a lateral load to a primary conductor of the subsea well;

(g2) pulling the primary conductor toward a vertical orientation.

9. The method of claim 8, further comprising:

(h) moving the tension assembly relative to the interface assembly and the tension member in the second axial direction;

(i) preventing the tension member from moving in the first axial direction relative to the interface assembly during (h).

10. The method of claim 9, wherein the tension member is a chain including a plurality of vertically oriented links and a plurality of horizontally oriented links coupled to the plurality of vertically oriented links, wherein one horizontally oriented link is disposed between each pair of adjacent vertically oriented links;

wherein (e) comprises pivoting a chuck of the tension assembly downward into engagement with an end of one of the vertically oriented links; and wherein (i) comprises pivoting a chuck of the interface assembly downward into engagement with an end of one of the vertically oriented links.

11. The method of claim 9, wherein (f) comprises extending a linear actuator coupled to a horizontal support plate of the tension assembly and a horizontal support plate of the interface assembly; and wherein (h) comprises retracting the linear actuator.

12. The method of claim 9, wherein the interface assembly includes a plurality of chucks disposed in the first channel, wherein each chuck of the interface assembly is configured to pivot about a horizontal axis between an unlocked position allowing the tension member to move through the first channel in second axial direction and a locked position preventing the tension member from moving through the first channel in the first axial direction.

13. The method of claim 12, wherein (i) comprises transitioning only one of the plurality of chucks to the locked position with the other of the plurality of chucks in the unlocked position.

14. A system for pulling a subsea structure, the system comprising:

a pile secured to the sea floor;

an adapter mounted to an upper end of the pile;

an interface assembly coupled to the adapter, wherein the interface assembly includes a pair of laterally spaced guide members, a recess disposed between the guide members, a retainer disposed in the recess, and a tension member disposed in the recess and positively engaged by the retainer: and a tension assembly coupled to the interface assembly and configured to apply a tensile load to the tension member, wherein the tension assembly includes a base that slidingly engages the interface assembly and a traveling assembly moveably coupled to the base;

wherein a linear actuator has a first end coupled to the traveling assembly and a second end coupled to the base.

15. The system of claim 14, wherein the tension member is a chain and the retainer is a double claw.

16. The system of claim 14, wherein the traveling assembly includes a support frame, a second linear actuator coupled to the support frame, and a tension member grab coupled to the second linear actuator;

wherein the second linear actuator is configured to move the tension member grab vertically up and down;

wherein the tension member grab is configured to positively engage and grasp the tension member.

17. The system of claim 16, wherein the frame includes a base plate and a pair of bearing walls extending perpendicularly upward from the base plate;

wherein the linear actuator is coupled to the bearing walls' wherein the base plate slidingly engages a pair of guide rails coupled to the base.

18. The system of claim 14, wherein the base has an outer surface including a shoulder that engages the guide members.

19. The system of any of claim 14, wherein the subsea structure is a primary conductor of a subsea well.

20. A system for pulling a subsea structure, the system comprising:

an anchor configured to be secured to the sea floor;

a linear actuator having a central axis, a first end coupled to the anchor, and a second end opposite the first end, wherein the linear actuator is configured to move the first end axially relative to the second end;

a flexible tension member having a first end coupled to the second end of the linear actuator and a second end configured to be coupled to the subsea structure:

wherein the flexible tension member extends through a retaining mechanism coupled to the anchor, wherein the retaining mechanism is configured to allow the tension member to move therethrough in a first direction and prevent the tension member from moving therethrough in a second direction opposite the first direction.

21. The system of claim 20, wherein the anchor comprises a suction pile.

22. The system of claim 21, further comprising an adapter mounted to an upper end of the suction pile, wherein the adapter has a lower end, an upper end, a receptacle extending from the lower end and configured to receive the upper end of the anchor.

23. The system of claim 22, wherein the first end of the linear actuator is coupled to a stabbing member releasably locked within a mating receptacle in the upper end of the adapter.

24. The system of claim 21, wherein the adapter is a pile top assembly configured to be releasably locked onto the upper end of the anchor.

25. The system of claim 20, wherein the retaining mechanism comprises a cleat.

26. The system of claim 20, wherein the flexible tension member comprises a wire rope or a synthetic rope.

27. The system of claim 20, wherein the linear actuator comprises a double acting hydraulic cylinder.

28. The system of claim 27, wherein the linear actuator includes a control system comprising an ROV panel including a hot stab receptacle configured to receive an ROV hot stab that supplies hydraulic pressure to the hydraulic cylinder and relieves hydraulic pressure foam the hydraulic cylinder.

29. The system of claim 28, wherein the control system further comprising a cross-piloted check valve disposed along a first hydraulic line extending from the hot stab receptacle to the hydraulic cylinder and disposed along a second hydraulic line extending from the hot stab receptacle to the hydraulic cylinder.

* * * * *